US005655178A

United States Patent [19]

Ishikawa et al.

[11] Patent Number: 5,655,178

[45] Date of Patent: Aug. 5, 1997

[54] ELECTROPHOTOGRAPHIC APPARATUS HAVING CLEANING DEVICE AND DEVELOPING DEVICE CONFIGURED TO PREVENT TONER LEAKAGE

[75] Inventors: Masaaki Ishikawa; Michihisa Iguchi; Hiroshi Hashizume; Tetsuya Nakamura; Kouichirou Satou; Yoshiaki Okano; Hirotaka Fukuyama; Satoshi Katagata; Takashi Ishikawa; Seiji Arai; Chinobu Sakai; Takahito Kabai, all of Tokyo, Japan

[73] Assignee: Kabushiki Kaisha Toshiba, Kawasaki, Japan

[21] Appl. No.: 547,225

[22] Filed: Oct. 24, 1995

Related U.S. Application Data

[62] Division of Ser. No. 258,186, Jun. 10, 1994, Pat. No. 5,488,462, which is a division of Ser. No. 113,694, Aug. 31, 1993, abandoned.

[30] Foreign Application Priority Data

| | | | |
|---|---|---|---|
| Aug. 31, 1992 | [JP] | Japan | 4-231675 |
| Aug. 31, 1992 | [JP] | Japan | 4-257321 |
| Aug. 31, 1992 | [JP] | Japan | 4-257322 |
| Sep. 25, 1992 | [JP] | Japan | 4-256780 |

[51] Int. Cl.[6] ..... G03G 15/08; G03G 21/00

[52] U.S. Cl. ..... 399/102; 399/103

[58] Field of Search ..... 355/215, 245, 355/253, 259, 296, 299; 118/651–653; 399/102, 103, 105, 106

[56] References Cited

U.S. PATENT DOCUMENTS

| | | | |
|---|---|---|---|
| 4,873,940 | 10/1989 | Ishikawa et al. | 118/651 |
| 4,893,151 | 1/1990 | Yamazaki et al. | 355/245 |
| 5,029,316 | 7/1991 | Koiso | 355/299 |
| 5,057,868 | 10/1991 | Sekino et al. | 355/215 |
| 5,073,797 | 12/1991 | Ono et al. | 355/215 |
| 5,075,728 | 12/1991 | Kobayashi et al. | 355/245 X |
| 5,134,960 | 8/1992 | Shirai | 118/653 |
| 5,212,521 | 5/1993 | Ogawa et al. | 355/215 |
| 5,274,425 | 12/1993 | Fukumoto et al. | 355/215 |
| 5,321,473 | 6/1994 | Azami | 355/245 |
| 5,455,665 | 10/1995 | Baba et al. | 355/296 X |
| 5,502,547 | 3/1996 | Shirai | 355/215 |

FOREIGN PATENT DOCUMENTS 2-26228 6/1990 Japan .

*Primary Examiner*—William J. Royer

*Attorney, Agent, or Firm*—Finnegan, Henderson, Farabow, Garrett & Dunner, L.L.P.

[57] ABSTRACT

A developing device used in an electrophotographic apparatus has seal members fixedly disposed between both end portions of a developing roller and those portions of inner walls of a device casing which correspond to both end portions of the developing roller. The seal members are made of a material which can be charged by friction with the developing roller to have the same polarity as charged toner. The toner is blocked by the seal members and presented from entering end portions of the developing roller.

5 Claims, 12 Drawing Sheets

ELECTROPHOTOGRAPHIC APPARATUS HAVING CLEANING DEVICE AND DEVELOPING DEVICE CONFIGURED TO PREVENT TONER LEAKAGE

This is a division of application Ser. No. 08/258,186, filed Jun. 10, 1994, now U.S. Pat. No. 5,488,462, which is a divisional of Ser. No. 08/113,694, filed Aug. 31, 1993, now abandoned.

BACKGROUND OF THE INVENTION

1. Field of the Invention

The present invention relates to an electrophotographic apparatus for printing images by an electrophotographic process, and to a developing device and a cleaning device used in the electrophotographic apparatus.

2. Description of the Related Art

In an electrophotographic apparatus, after the surface (photosensitive surface) of a photosensitive drum is charged by a charger at a predetermined potential (e.g. −600 V), the photosensitive surface is exposed by an exposing device in accordance with an image to be printed. Thereby, an electrostatic latent image is formed on the photosensitive surface of the photosensitive drum. The electrostatic latent image is developed by a developing device which applies toner on the photosensitive surface of the photosensitive drum in accordance with the electrostatic latent image. The developed toner image formed on the photosensitive surface of the photosensitive drum is transferred onto a printing paper sheet by a transferring device. Finally, the toner image is fixed on the paper sheet by a fixing device. The toner left on the photosensitive drum after transfer is removed by a cleaning device.

A known developing device, used in the above electrophotographic apparatus, is one which adopts a non-magnetic monocomponent developing system. According to this system, while non-magnetic toner is charged to have a predetermined polarity, the toner is adhered to a developing roller by an electromagnetic force due to the charge and the toner is conveyed onto the photosensitive drum by rotating the developing roller.

The developing device according to this system comprises a device casing which contains toner, a rotatable developing roller situated at that part of the casing which is opened to the photosensitive drum, and a toner restriction member for forming a thin toner layer on the peripheral surface of the developing roller and charging the toner.

Both side end portions of a roller shaft for supporting the developing roller are rotatably supported at the side walls of the device casing. One half of the circumferential surface of the developing roller is directed to the inside of the device casing, and the other half is exposed to the outside.

The toner restriction member, having a shape of e.g. blade, extends in the axial direction of the developing roller. In addition, the toner restriction member is situated above the developing roller in parallel, and it is put in contact with the peripheral surface of the developing roller. The toner restriction member is not provided at the both end portions of the developing roller since the end portions of the roller are rotatably supported by the side walls.

The non-magnetic toner contained within the device casing is supplied to the developing roller by a supply roller situated on the inside of the developing device, and the non-magnetic toner is carried on the developing roller. The toner carried on the developing roller is conveyed as the developing roller is-rotated, and the toner is put in contact with the photosensitive drum. While the toner is conveyed by the developing roller, it is passed between the developing roller and the toner restriction member. Thereby, a layer of toner adhered to the developing roller is thinned and charged. The toner is adhered to the developing roller by the electromagnetic force of the charge.

In this developing device, the toner is adhered to the peripheral surface of the developing roller only by the electromagnetic force acting between the peripheral surface of the developing roller and the toner. The amount of charge of the toner adhered to those portions of the developing roller located in the longitudinal direction of the roller, where the toner restriction member is not provided, is low. Thus, the electromagnetic force of the toner, adhered to the ends of the developing roller, is low.

Thus, the toner on both end portions of the developing roller, where the toner restriction member is not present, may flow off the end faces of the developing roller and escape out of the device casing of the developing device through a gap between the end face of the developing roller and the side wall of the device casing. If the toner escapes from the developing device, the toner can flow into the body of the apparatus (e.g. facsimile), including the electrophotographic apparatus or printing device, and will contaminate the inside of the apparatus.

In order to solve the above problem, there is known a conventional technique as shown in Japanese Patent Publication (KOKOKU) JP-A 2-26228. According to this technique, a lubricating seal material and a non-rotatable member are provided at each end of the developing roller. The two lubricating seal materials and two non-rotatable members have cylindrical shapes of the same diameter as the developing roller. The lubricating seal materials and non-rotatable members are loosely fitted on the shaft of the developing roller, and these components constitute a single cylindrical body. The non-rotatable members are positioned in close contact with the side walls of the device casing, and even if the developing roller rotates, the non-rotatable members do not rotate. The lubricating seal material is formed by attaching a lubricating film to an elastic member, and it has elasticity and lubricating properties. Thus, the lubricating seals are put in contact with the end portions of the developing member and non-rotatable members in good condition, while not preventing the rotation of the developing member.

According to this structure, escape of toner from a gap between the end face of the developing roller and the device casing can be prevented to some extent. However, with this structure, a gap is formed between the non-rotatable members and the toner restriction member, and therefore toner present at both end portions of the developing roller cannot be completely prevented from flowing off the end faces of the developing roller.

On the other hand, the cleaning device comprises a waste toner tank, and a blade attached to the waste toner tank so as to be in contact with the photosensitive drum. In the cleaning device, toner left on the photosensitive drum after transfer is removed by the blade and put in the waste toner tank.

In the cleaning device, a gap is formed between the waste toner tank and the photosensitive drum. Thus, there is a possibility that toner contained in the waste toner tank could escape from the waste toner tank through the gap between the waste toner tank and the photosensitive drum. If the-toner escapes from the waste toner tank, it will flow out into the inside of the apparatus (e.g. facsimile) containing the electrophotographic apparatus or printing device and contaminate the inside of the apparatus.

SUMMARY OF THE INVENTION

An object of the present invention is to provide a developing device used in an electrophotographic apparatus, wherein toner adhered to a developing roller can be prevented from escaping from both ends of the developing roller.

Another object of the present invention is to provide a cleaning device used in an electrophotographic apparatus, wherein toner contained in a waste toner tank can be prevented from escaping through a gap between the waste toner tank and a photosensitive member.

According to the present invention, there is provided a developing device for developing an electrostatic latent image formed on a surface of a photosensitive member by using toner which is charged by friction between a developing roller and a toner restriction member to have a predetermined polarity, the developing device comprising:

a casing including an inner wall facing side end portions of a surface of the developing roller, the inner wall being located at an upstream side of conveyance of toner with respect to the toner restriction member; and a seal member disposed between the side end portions of a surface of the developing roller and the inner wall of the casing.

According to the present invention, there is provided another developing device for charging toner by using a developing roller and a toner restriction member to have a predetermined polarity and for developing an electrostatic latent image formed on a surface of a photosensitive member by using charged toner, the developing device comprising:

a casing including an inner wall facing side end portions of a surface of the developing roller, the inner wall being located at an upstream side of conveyance of toner with respect to the toner restriction member;

a first seal member disposed between the side end portions of a surface of the developing roller and the inner wall of the casing;

means for supporting the toner restriction member, the toner restriction member extending along the developing roller except the side end portions of the developing roller; and a second seal member disposed between the supporting means and the developing roller.

According to the present invention, there is provided a further developing device for developing an electrostatic latent image formed on a surface of a photosensitive member by using toner, the developing device comprising:

a developing roller for carrying and conveying toner and putting the toner into contact with the surface of the photosensitive member;

a toner restriction member, arranged to be in contact with the developing rollers for restricting an amount of toner carried and conveyed by the developing roller and charging the toner by friction; and means for supporting the toner restriction member such that the toner restriction member is linearly movable only in such a direction as to approach and move away from the developing roller.

According to the present invention, there is provided a still another developing device for developing an electrostatic latent image formed on a surface of a photosensitive member by using toner, the developing device comprising:

a casing for containing toner;

a developing roller for carrying the toner at a predetermined toner carrying area and conveying the toner, and putting the toner into contact with the surface of the photosensitive member; and a supply roller, having a width less than the width of the toner carrying area of the developing roller, for carrying and conveying the toner contained in the casing and supplying the toner to the developing roller.

According to the present invention, there is provided a still further developing device for developing an electrostatic latent image formed on a surface of a photosensitive member by using toner, the developing device comprising:

a casing for containing toner;

a developing roller for carrying the toner at a predetermined toner carrying area and conveying the toner, and putting the toner into contact with the surface of the photosensitive member; and a toner receiving member, having a length substantially corresponding to the width of the toner carrying area of the developing roller, for receiving the toner which has been put in contact with the surface of the photosensitive member and returned into the casing while being carried by the developing roller.

According to the present invention, there is provided a cleaning device for removing toner attached to a surface of a photosensitive member, the cleaning device comprising:

a toner container for containing toner removed from the surface of the photosensitive member;

a toner removing member fixed to the toner container and adapted to be put in contact with the surface of the photosensitive member;

a toner receiving member, fixed to the toner container, for receiving the toner removed from the surface of the photosensitive member and guiding the toner to the toner container;

a first seal member, attached to the toner container, for sealing a gap between the toner container and the toner removing member; and a second seal member, attached to the toner container, for sealing a gap between the toner container and the toner receiving member.

Additional objects and advantages of the present invention will be set forth in the description which follows, and in part will be obvious from the description, or may be learned by practice of the present invention. The objects and advantages of the present invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the present invention and, together with the general description given above and the detailed description of the preferred embodiments given below, serve to explain the principles of the present invention in which.

DETAILED DESCRIPTION OF THE PREFERRED EMBODIMENTS

A preferred embodiment of an electrophotographic apparatus according to the present invention will now be described with reference to the accompanying drawings.

Figure 1:
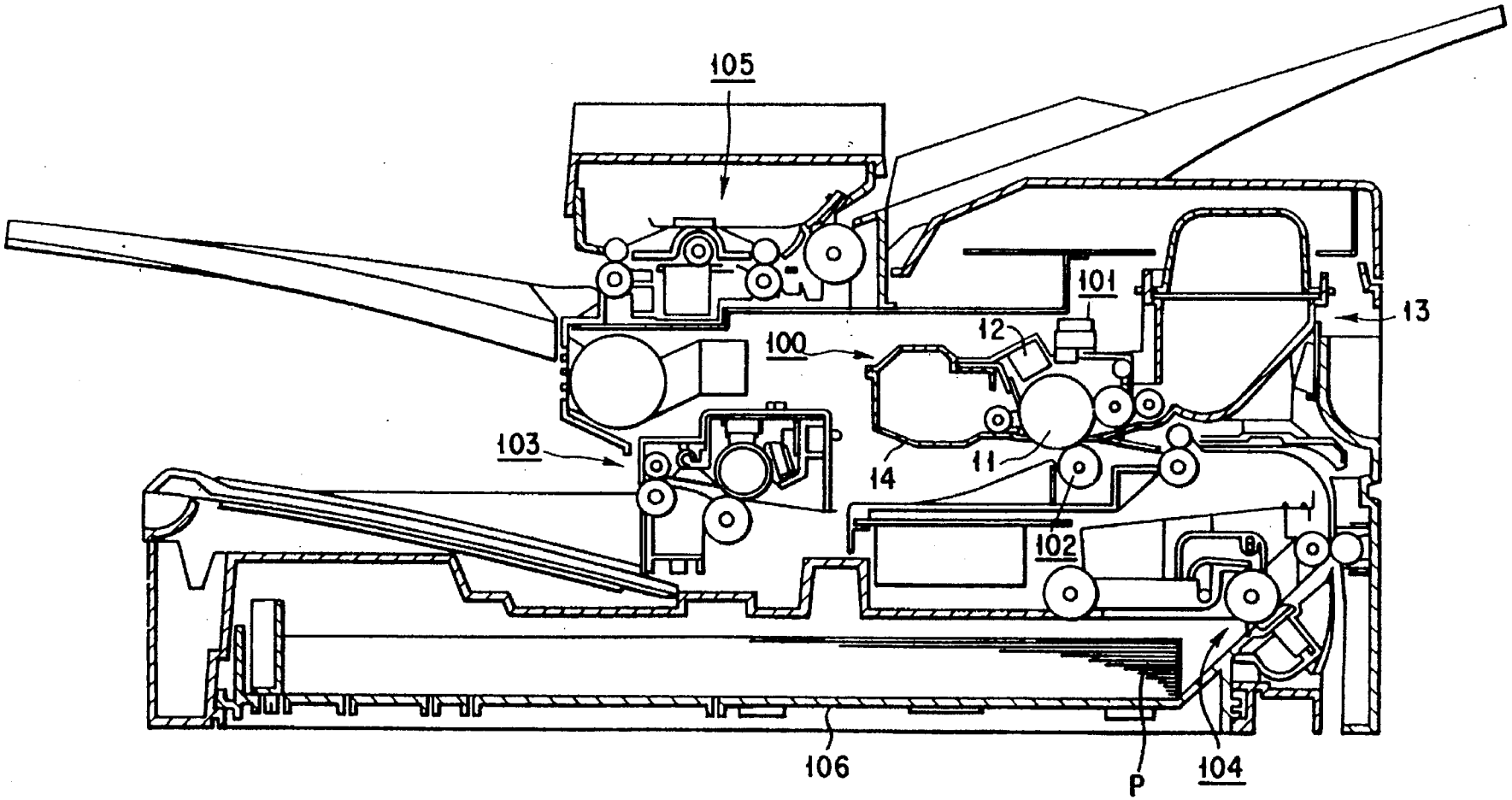
FIG. 1 is a partly exploded view showing the entire structure of a facsimile apparatus including an electrophotographic apparatus which is provided with a developing device and a cleaning device according to the present invention.

FIG. 1 is a partially sectional view showing the entire structure of a facsimile apparatus to which an electrophotographic apparatus of the present invention is given.

This facsimile apparatus has a process unit 100, an exposure device 101, a transfer device 102, a fixing unit 103, a paper feed mechanism section 104, and a transmission mechanism section 105.

The process unit 100 is formed as an integral structure of a photosensitive drum 11, a charging device 12, a developing device 13, and a cleaning device 14, and forms a toner image on the surface of the photosensitive drum 11 together with the exposure device 101 in accordance with the so-called Carlson process. The process unit 100 is detachably provided to the main body of the facsimile apparatus.

The exposure device 101 includes an LED head and forms an electrostatic latent image on the photosensitive surface of the photosensitive drum 1 by exposing the photosensitive drum 11.

The transfer device 102 transfers the toner image formed on the photosensitive drum 11 onto a printing sheet P fed by the paper feed mechanism section 104. A large number of printing sheets P are stored in a printing sheet tray 106.

The fixing unit 103 fixes the toner image transferred to a printing sheet P.

The transmission mechanism section 105 optically reads an original to be transmitted and performs photoelectric conversion to generate an image signal. The transmission mechanism section 105 is connected to a communication line (not shown).

Figure 2:
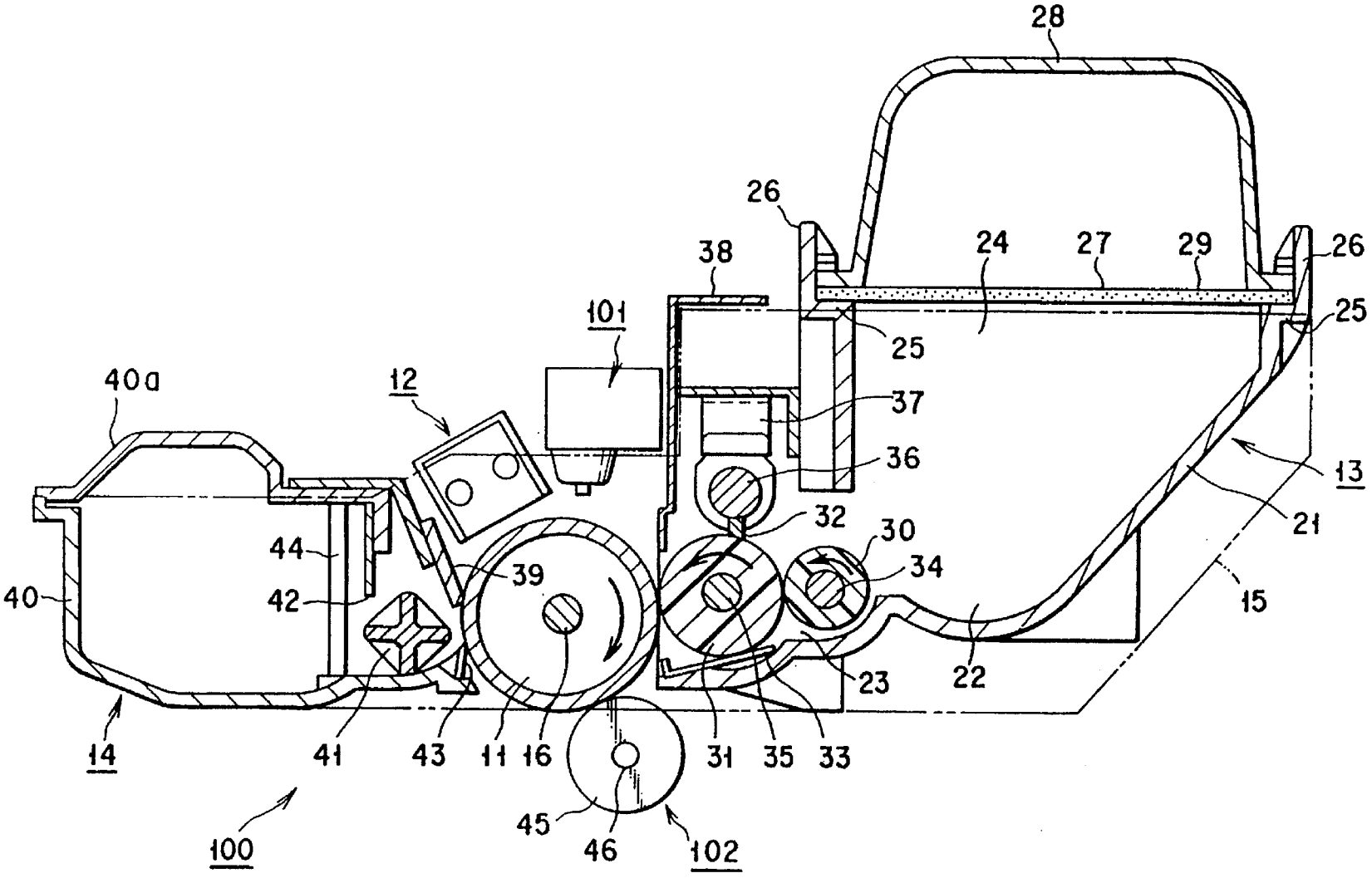
FIG. 2 is a partly exploded view showing the detailed structure of a process unit shown in FIG. 1.

FIG. 2 is a partially sectional view showing the structure of the process unit 100 and the transfer device 102 in detail. Note that the same reference numerals are used to denote the same portions as in FIG. 1. The charging device 12, the exposure device 101, the developing device 13, the transfer device 102, and the cleaning device 14 are arranged around the photosensitive drum 11 along the outer surface of the photosensitive drum 11. Of these components, the photosensitive drum 11, the charging device 12, the developing device 13, and the cleaning device 14 are integrally supported by unit plates 15 arranged at sides of the process unit 100.

The photosensitive drum 11 is made of a cylindrical conductor, e.g., aluminum. The outer surface of the cylindrical conductor is coated with a photosensitive conductive material to form a photosensitive layer. The photosensitive drum 11 has a width larger than the maximum-width of the printing sheet P. A drum shaft 16, which is supported by the unit plates 15, is rotatably inserted into the photosensitive drum 11 and the photosensitive drum 11 is rotated on the shaft 16.

The charging device 12 comprises, e.g., a known scorotron charger and uniformly charges the surface of the photosensitive drum 11 to a predetermined potential (e.g., −600 V). The charging device 12 includes a long scorotron shield case arranged in parallel with the photosensitive drum 11 and a discharge wire provided in the case.

The developing device 13 comprises a device casing 21, a toner pack 28, a feed roller 30, a developing roller 31, a developing blade 32, a receiving blade 33, a support rod 36, a leaf spring 37, and a reinforcing plate 38.

The device casing 21 has a width substantially equal to that of the photosensitive drum 11 and is arranged in parallel with the photosensitive drum 11. In the device casing 21, there are provided a toner hopper 22 and a roller-locating portion 23 positioned between the toner hopper 22 and the photosensitive drum 11. The toner hopper 22 and the roller-locating portion 23 communicate with each other.

The device casing 21 has a rectangular toner inlet 24 whose upper surface is open along the axial direction of the photosensitive drum 11. A portion of the device casing 21 surrounds the toner inlet 24 and is provided with flanges 25. A seal member 27, formed of a sponge, is adhered on the flanges 25 surrounding the toner inlet 24. Ribs 26 are formed in the seal member 27 at a position corresponding to longer sides of the rectangular toner inlet 24.

The toner pack 28 is a parallelepiped container made of a resin and having a cross section of the same size as the toner inlet 24. A lower face of the toner pack 28 is provided a rectangular toner outlet 29. The toner pack 28 is filled with toner (not shown), and the toner outlet 29 is sealed with a seal sheet (not shown) formed of a resin film.

The toner pack 28 is mounted on the toner inlet 24 of the device casing 21. The toner pack 28 is detachably mounted on the device casing 21. To detachably mount the toner pack 28 on the device casing 21, a claw (not shown) is formed in the toner pack 28 and an engagement portion, with which the claw is engaged, is formed in the device casing 21.

In the roller-locating portion 23 of the device casing 21, there are provided the feed roller 30, the developing roller 31, the developing blade 32, and the receiving blade 33.

The feed roller 30 is made of a synthetic resin and is fixed to a roller shaft 34. The developing roller 31 is made of a synthetic resin and is fixed to a roller shaft 35. The roller shafts 34 and 35 are supported by side walls of the device casing 21 such that the shafts 34 and 35 rotate. The developing roller 31 contacts both the photosensitive drum 11 and the feed roller 30.

The feed roller 30 and the developing roller 31 are rotated in the counterclockwise direction by a rotary drive mechanism (not shown). The feed roller 30 carries the toner stored in the toner hopper 22 and supplies it to the developing roller 31. The developing roller 31 carries the toner given by the feed roller 30 and causes it to contact the surface of the photosensitive drum 11.

The developing blade 32 is made of a silicone resin, urethane, or the like. The developing blade 32 is supported by the support rod 36 arranged parallel to and above the developing roller 31 and contacts the developing roller 31. The developing blade 32 is connected to the support rod 36 at the lower portion. The support rod 36 is supported by the side walls of the device casing 21 such that the rod 36 can be displaced in the vertical direction.

The support rod 36 is urged toward the developing roller 31 by the leaf spring 37, with a predetermined force F (about 50 g/cm$^2$ to 100 g/cm$^2$). Thus, the developing blade 32 is urged against the developing roller 31 with the force F so that the toner conveyed to the developing roller 31 is formed into a film layer and is charged by friction.

The receiving blade 33 is made of e.g., a resin plate with elasticity, and is located under the developing roller 31, close to the photosensitive drum 11, and parallel with the developing roller 31. Further, the blade 33 is connected to a bottom wall of the device casing 21 at one end and to a surface of the developing roller 31 at the other end. The blade 33 prevents toner contained in the roller-locating portion 23, from escaping from downward of the developing roller 31 to the outside of the device casing 21, and also guides toner, which has fallen from the developing roller 31, to the interior of the device casing 21 in accordance with rotation of the developing roller 31.

The reinforcing plate 38 is arranged between the exposure device 101 and the developing roller 31 and is parallel with the shaft of the developing roller 31. The plate 38 is fixed to the device casing 21. The plate 38 partitions the exposure device 101 and the developing roller 31.

The cleaning device 14 comprises a cleaning blade 39, a waste toner tank 40, a waste toner collecting roller 41, a one-way valve 42, a receiving blade 43, and a rib 44. The cleaning blade 39 scrapes off the residual toner attaching to the photosensitive drum 11 after the transfer procedure by the transfer device 102. The waste toner tank 40 collects the residual toner which is scraped from the photosensitive drum 11 by the cleaning blade 39. The waste toner tank 40 has an opening at the upper surface which is covered by a lid 40*a*. The waste toner collecting roller 41 conveys the toner scraped by the cleaning blade 39 to the waste toner tank 40. The one-way valve 42 prevents the toner in the waste toner tank 40 from flowing back to the photosensitive drum 11. The receiving blade 43 receives the residual toner which is scraped from the photosensitive drum 11 by the cleaning blade 39 and guides the received toner into the waste toner tank 40. The rib 44 supports the bottom of the waste toner tank 40 and the lid 40*a*. The rib 44 prevents the bottom of the waste toner tank 40 and the lid 40*a* from being bent even if the bottom of the waste toner tank 40 and the lid 40*a* receive the rotational force of the photosensitive drum 11 through the cleaning blade 39 and the receiving blade 43.

The transfer device 102 comprises a transfer roller 45 which is arranged in parallel to and in contact with the photosensitive drum 11. The transfer roller 45 is made of a conductive resin and is fixed to a roller shaft 46.

Figure 3A:
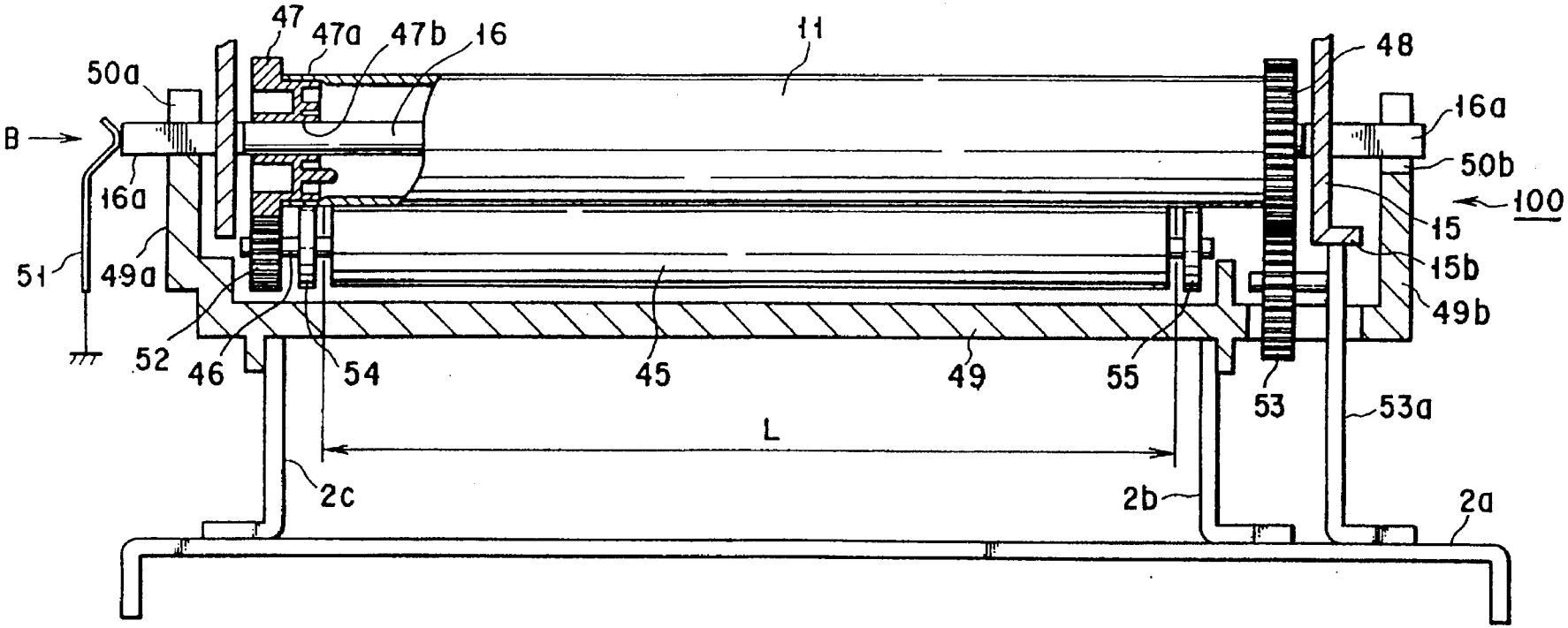
FIGS. 3A and 3B are cross-sectional views showing in detail the structure of a photosensitive drum shown in FIG. 1.

As is shown in FIG. 3A, there are gaps between both end portions of the photosensitive drum 11 and side walls 49*a* and 49*b*, and gears 47 and 48 made of an electrically conductive synthetic resin are attached to both end portions of the drum 11.

The gear 47 is provided with a cylindrical portion 47*a* coaxially, and the outside diameter of the cylindrical portion 47*a* is substantially equal to the diameter of the photosensitive drum 11. A circular hole 47*b* is formed at a center portion of the gear 47. The cylindrical portion 47*a* of the gear 47 is fitted into one end portion of the photosensitive drum 11 and is fixed in the drum 11 by means of, e.g. adhesive.

The gear 48 has the same structure as the gear 47. The gear 48 is fitted in the other end portion of the photosensitive drum 11 and is fixed to the drum 11 by means of, e.g. adhesive.

The length of the drum shaft 16 is greater than that of the photosensitive drum 11. The drum shaft 16 is situated coaxially within the drum 11. The drum shaft 16 extends outwards from both end portions of the drum 11 through the hole 47*a* of the gear 47 and a hole (not shown) of the gear 48. The diameter of the holes is greater than that of the shaft 16 such that the gears 47 and 48 and the drum 11 can be rotated on the shaft 16.

As described above, the combination of the drum shaft 16 formed of a cylindrical rod, the hole 47*a* of the gear and the hole of gear 48 enables the gears 47 and 48 to be rotated on the drum shaft 16. Since the photosensitive drum 11 is combined integrally with the gears 47 and 48, the drum 11 is rotated on the shaft 16.

Figure 3B:
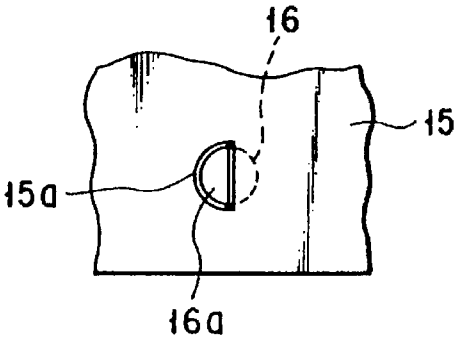

Both end portions of the drum shaft 16, which project out of the photosensitive drum 11, have semicircular notch portions 16*a* each having a semicircular cross section perpendicular to the axis of the drum shaft 16, as shown in FIG. 3B. A hole 15*a* having the same shape as the cross section of the semicircular notch portion 16*a* of the drum shaft 16 is formed in each of both side portions of the unit plate 15 (which correspond to both end portions of the drum 11). Each semicircular notch portion 16*a* of the drum shaft 16 is inserted in the associated hole 15*a*. In this case, the semicircular cross-sectional face of each semicircular notch portion 16*a* is engaged with the semicircular cross-sectional area of the associated hole 15*a*. Thus, the drum shaft 16 is fixedly supported. FIG. 3B shows the hole 15*a* and semicircular notch portion 16*a*, as viewed in the direction of arrow B in FIG. 3A.

Both end portions of the drum shaft 16 are engaged with U-shaped grooves 50*a* and 50*b* formed in both side walls 49*a* and 49*b* of the support member 49. The support member 49 is fixed on side plates 2*b* and 2*c* bent upwards from a base member 2*a*.

A ground contact element 51 is put in contact with an end face of one end portion 16*a* of the drum shaft 16. The contact element 51 is formed-of an electrically conductive metallic material having elasticity. The contact element 51 is attached to a member (not shown) provided on the apparatus body in the vicinity of an end portion of the drum shaft 16, and the contact element 51 is electrically grounded. A tip portion of the contact element 51 is put in contact with the end face of the drum shaft 16 with elasticity.

The gear 47 is meshed with a gear 52 attached to one end of the roller shaft 46 of the transfer roller 45. The gear 48 is meshed with a drive gear 53 which is a part of the rotation drive apparatus. The drive gear 53 is supported on a drive system support member 53*a* which is fixed on the base member 2*a*. An upper end portion of the drive system support member 53*a* is put in contact with a contact portion 15*b* formed at a lower part of the unit plate 15.

A torque of a motor (not shown) in the rotation drive apparatus is transmitted to the gear 48 via the drive gear 53, and thus the photosensitive drum 11 is rotated.

Since the semicircular notch portions 16*a* are tightly fitted in the holes 15*a*, the photosensitive drum 11 rotates independently of the drum shaft 16 and the drum shaft 16 does not rotate. Since the drum shaft 16 does not rotate, the ground contact element 51 is not vibrated by the rotation of the drum shaft 16. Accordingly, defective contact between the drum shaft 16 and the ground contact element 51 can be avoided, and the drum shaft 16 is always in stable contact with the ground contact element 51.

Electric conduction between the photosensitive drum 11 and the ground contact element 51 is made through a passage extending from the photosensitive drum 11 through the gears 47 and 48, the drum shaft 16 and finally to the ground contact element 51. Since the gears 47 and 48 are made of an electrically conductive material and are put in direct contact with the photosensitive drum 11, there is no need to provide a special electrical contact member between the gears and the drum and the structure for electrical conduction therebetween is simplified.

The structure for preventing rotation of the drum shaft 16 is not limited to the above.

When the photosensitive drum 11 rotates, the torque thereof is transmitted to the roller shaft 46 of the transfer roller 45 via the gears 47 and 52. Thus, the transfer roller 45 is rotated.

Rollers 54 and 55 made of a solid resin are attached to the roller shaft 46 outside the transfer roller 45. The rollers 54 and 55 determine the nip width of the transfer roller 45 on the photosensitive drum 11, and the rollers 54 and 55 are put in contact with the drum 11 at outside portions of a photosensitive layer formation area L. The rollers 54 and 55 are put in contact with the portions outside of the photosensitive layer formation area L in order to prevent the photosensitive layer of the drum 11 from being contaminated or damaged by the rollers 54 and 55. This structure can also be used to determine the nip width between the photosensitive drum 11 and developing roller 31 in the developing device 13.

With the facsimile apparatus having the above structure, the image printing is performed in the following manner.

The surface (photosensitive surface) of the photosensitive drum 11 is charged by the charging device 12 at a predetermined potential (e.g. −600 V). The charged photosensitive surface of the drum 11 is exposed by the exposure device 101 in accordance with an image to be printed, and an electrostatic latent image is formed on the photosensitive surface. The electrostatic latent image formed on the photosensitive surface of the drum 11 is developed by the developing device 13.

In the developing device 13, toner supplied from the toner hopper 22 mainly by the supply roller 30 is carried on the developing roller 31 and conveyed so that the toner is put in contact with the surface of the drum 11. As the toner carried on the developing roller 31 is conveyed, the thickness of a toner layer is decreased to be formed into a film layer and the toner is charged by friction with the same polarity ("negative" in this case) as the polarity of the charged potential of the photosensitive drum 11.

The developing roller 31 is supplied with a low developing bias (e.g. −200 V) having the same polarity as the charged potential of the drum 11 from a developing bias power supply (not shown). Toner is selectively adhered to the photosensitive drum 11 by an electric field generated in accordance with the electrostatic latent image, developing bias, and charge of toner. Specifically, toner is not adhered to a non-exposed area on the drum 11 since that area of the drum 11 has a potential higher than that of the toner. On the other hand, toner is adhered to the exposed and discharged area since that area of the photosensitive drum 11 has a potential lower than that of the toner. In this manner, a toner image corresponding to the electrostatic latent image is formed on the surface of the drum 11. The toner image is transferred onto the printing paper sheet P by the transfer device 102.

In the image printing mode, a positive transfer voltage (e.g. +1,350 V) is applied to the transfer roller 45 of the transfer device 102. The printing paper sheet p conveyed by the paper feed mechanism 104 is passed between the photosensitive drum 11 and the transfer roller 45, and a charge is applied to the rear face of the sheet P from the transfer roller 45. Since the polarity of the charge applied to the rear face of the sheet P is positive, the negatively charged toner is attracted to the printing paper sheet P, and thereby the toner image formed on the surface of the drum 11 is transferred onto the sheet P.

After the sheet P is separated from the drum 11, the toner remaining on the photosensitive surface of the drum 11 is removed by the cleaning device 14.

The general structure and operation of the facsimile apparatus have been described. The important structures according to the present invention will now be described in detail.

First Embodiment

Figure 4:
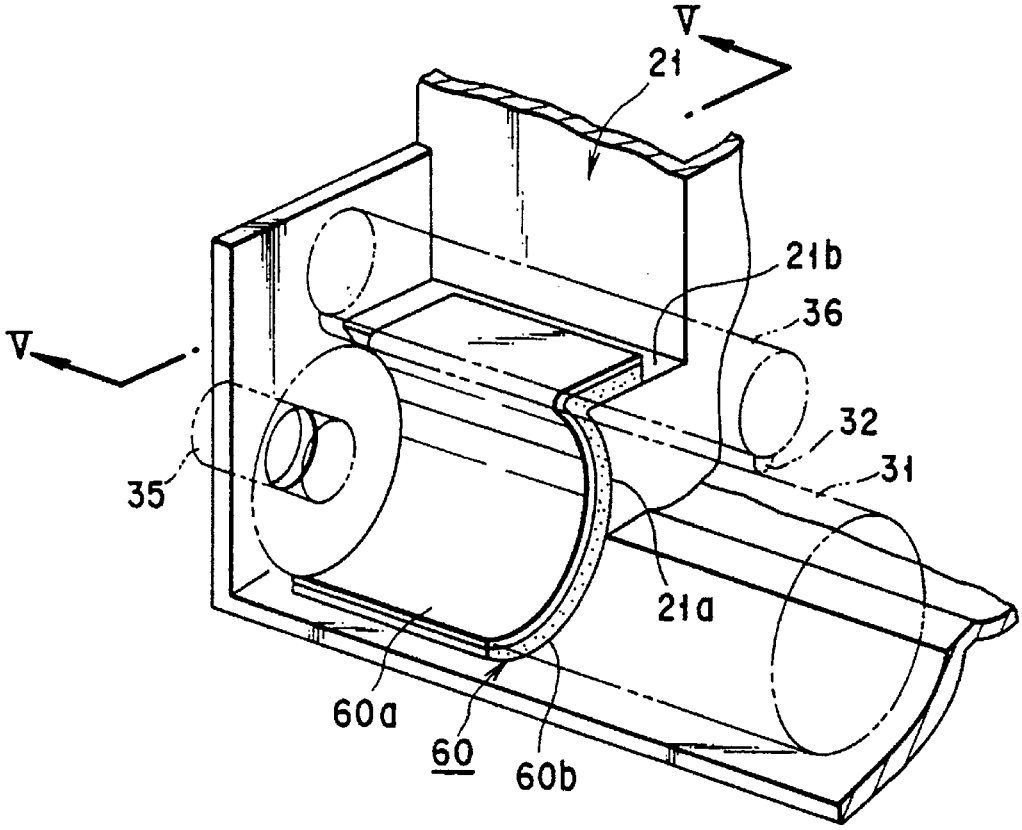
FIG. 4 is a perspective view showing a main structure of a developing device according to a first embodiment of the invention.
Figure 5:
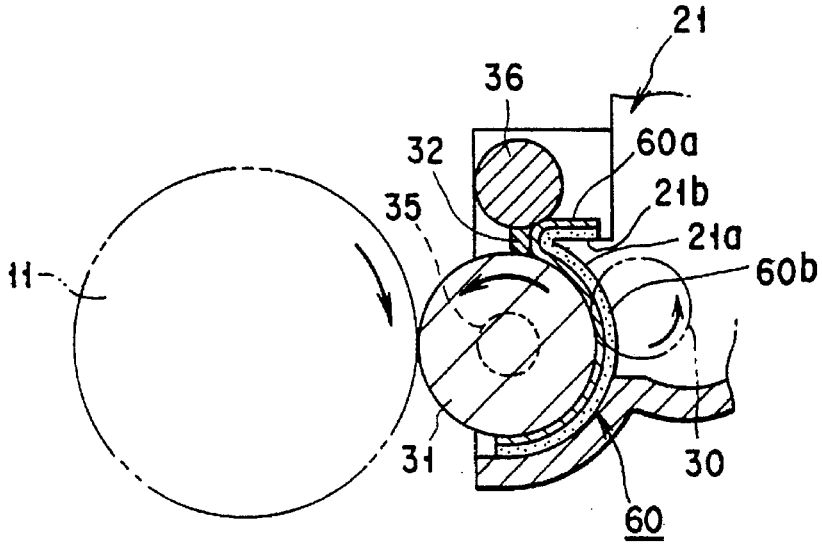
FIG. 5 is a cross-sectional view showing a main structure of the developing device shown in FIG. 4 taken along a line V—V shown in FIG. 4.

FIG. 4 is a perspective view showing a main structure of the developing device 13 according to a first embodiment of the invention, and FIG. 5 is a cross-sectional view showing a main structure of the developing device shown in FIG. 4 taken along a line V—V shown in FIG. 4. In FIGS. 4 and 5, the elements common to those shown in FIG. 2 are identified with like reference numerals.

As is shown in FIGS. 4 and 5, in the device casing 21, an arcuated portion 21*a* extending along the periphery of the developing roller 31 is formed at a position corresponding to an end portion of the developing roller 31. The arcuated portion 21*a* has a top portion situated near the developing blade 32 and on the toner hopper side of the developing blade 32, and the arcuated portion 21*a* extends to the lower portion of the developing roller 31. A horizontal stepped portion 21*b* is formed to extend from the top portion of the arcuated portion 21*a* towards the toner hopper 22. A seal member 60 is disposed on the arcuated portion 21*a* and stepped portion 21*b*. Stated another way, the arcuated portion 21*a* is located at the upstream side of conveyance of toner with respect to the developing blade 32. The seal member 60 has a seal film 60*a* and a sponge sheet 60*b* for lining the seal film 60*a*. The seal member 60 has a length greater than half the peripheral length of the developing roller 31 and has enough width to cover the end portion of the developing roller 31. The seal member 60 covers the peripheral surface of the roller 31 which faces the toner hopper 22.

The outer surface of the sponge sheet 60*b* is adhered to the arcuated portion 21*a* and stepped portion 21*b*, for example, by means of a double-sided adhesive tape. Thus, the seal member 60 is fixed on the apparatus casing 21 non-rotatably. The seal film 60*a* is supported by the sponge sheet 60*b* and is put in close contact with the peripheral surface of the developing roller 31.

The seal film 60*a* is made of a material which can be charged by friction with the developing roller 31 to have the same polarity as the polarity of the charged toner. For example, when the toner is made of a polyester material and can be charged negatively, the seal film 60*a* is made of a material which can be charged negatively through sliding contact with the developing roller 31. Specifically, from among chargeable high-molecule resin, a fluororesin such as polytetrafluoroethylene or polyethylene resin, for example, can be used.

FIGS. 4 and 5 show only the structure at one end portion of the developing roller 31, but the structure at the other end portion of the roller 31 is symmetric to that shown in FIGS. 4 and 5.

The seal member 60 is situated at the end portion of the developing roller 31 between the roller 31 and the device casing 21. Since the seal film 60*a* of the seal member 60 is in close contact with the developing roller 31, the surface of the developing roller 31 slides on the seal film 60*a* when the developing roller 31 rotates. Since the seal film 60*a* is made of material which can be charged by friction with the developing roller 31 to have the same polarity (negative polarity) as the polarity of the charged toner, the seal film 60*a* is charged negatively when it is put in sliding contact with the developing roller 31. On the other hand, since the toner is made of polyester material which can be charged negatively, it is charged negatively by various frictions within the device casing 21. Thus, a repulsive force acts between the toner and the seal film 60*a*, and the toner is prevented from entering the gap between the end portions of the developing roller 31 and the device casing 21.

In addition, the seal member 60 is adhered to the device casing 21 and closely contacted with the peripheral surface of the developing roller 31. Thus, the gap existing between the end portion of the roller 31 and the casing 21 is a sum of the surface roughness of the roller 31 and the surface roughness of the seal film 60*a* and is, therefore, very small. Accordingly, from a physical aspect, too, toner hardly enters the gap between the end portion of the developing roller 31 and the casing 21. In particular, if the surfaces of the roller 31 and seal film 60*a* are smoothed so that the sum of the surface roughness of the roller 31 and the surface roughness of the seal film 60*a* may be less than an average particle size of the toner, very few toner particles enter the gap between the end portion of the developing roller 31 and the device casing 21.

Since the toner is prevented from reaching the end portion of the developing roller 31, it is possible to entirely prevent the toner from flowing out of the casing 21 off the end portion of the roller 31 and flowing into the inside of the body of the facsimile apparatus.

When the developing roller 31 is formed of silicone rubber, the seal film 60*a* may be formed of a polyamide such as nylon in place of the fluororesin film.

In the first embodiment, the seal member 60 comprises the seal film 60*a* and sponge sheet 60*b*, but only the seal film 60*a* may be used as the seal member.

Second Embodiment

Figure 6:
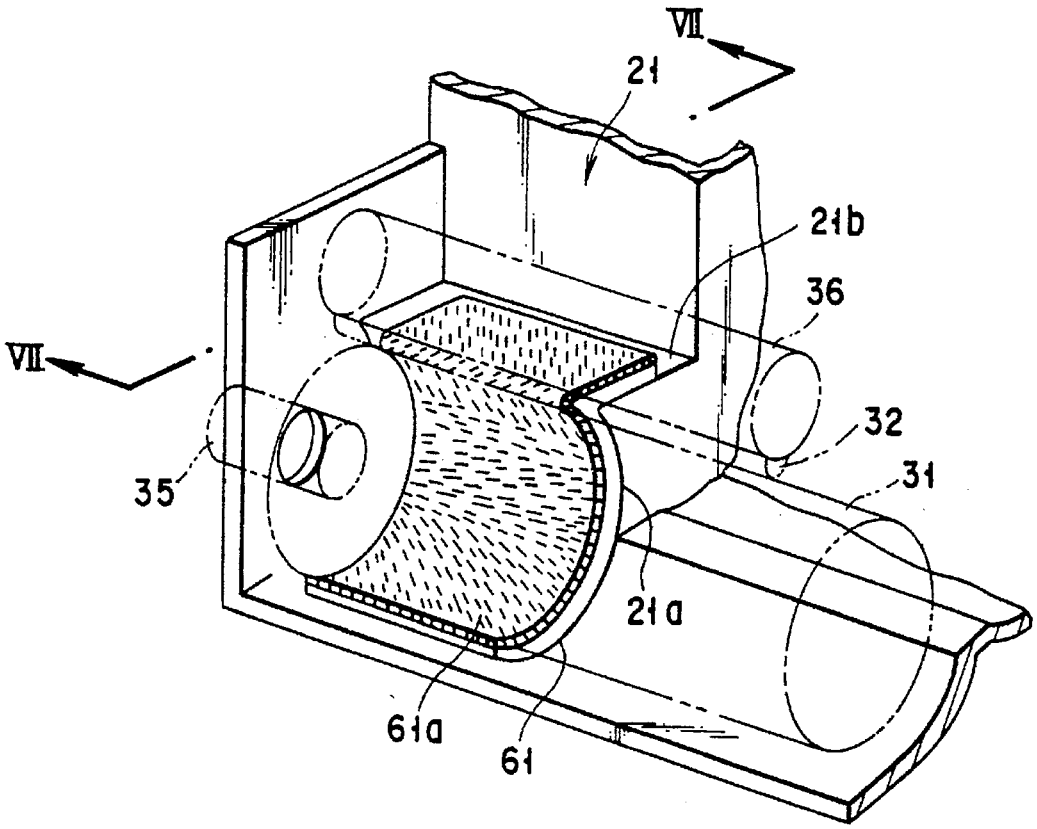
FIG. 6 is a perspective view showing a main structure of a developing device according to a second embodiment of the invention.
Figure 7:
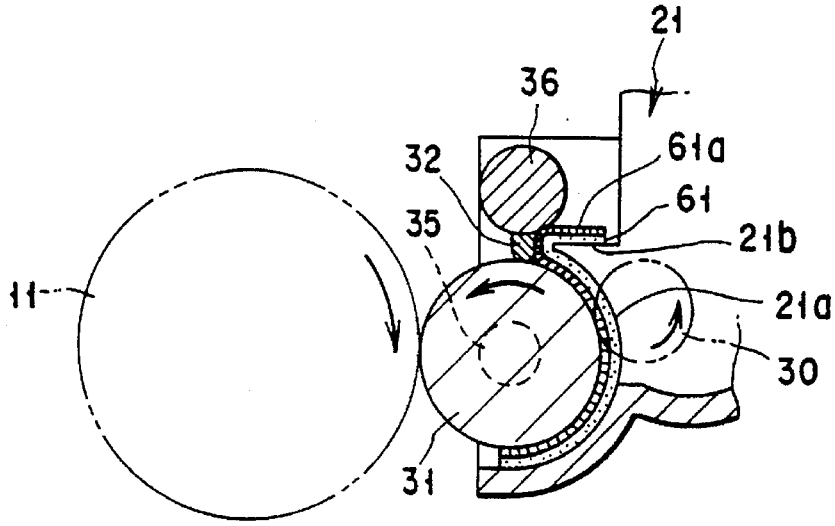
FIG. 7 is a cross-sectional view showing a main structure of the developing device shown in FIG. 6 taken along a line VII—VII shown in FIG. 6.

FIG. 6 is a perspective view showing a main structure of a developing device 13 according to a second embodiment of the invention. FIG. 7 is a cross-sectional view showing a main structure of the developing device shown in FIG. 6 taken along a line VII—VII shown in FIG. 6. In FIGS. 6 and 7, the elements similar to those shown in FIGS. 2, 4 and 5 are identified with same reference numerals.

The structure of the second embodiment is substantially identical to that of the first embodiment, except that the seal member 60 is replaced by a nappy (fiber) seal member 61.

The nappy seal member 61 has one surface napped so that a great number of short fibers 61*a* are erected. The seal member 61 is formed of fluorine-based fibers or acryl fibers. The other surface of the seal member 61, on which no fibers 61*a* are formed, is adhered to the arcuated portion 21*a* and stepped portion 21*b* by, e.g. a double-sided adhesive tape (not shown). Thus, the nappy seal member 61 is fixed on the device casing 21 in a non-rotatable state. The fibers 61*a* are put in contact with the peripheral surface of the developing roller 31.

FIGS. 6 and 7 show only the structure at one end portion of the developing roller 31, but the structure at the other end portion of the roller 31 is symmetric to that shown in FIGS. 6 and 7.

Since the nappy seal member 61 is situated on the end portions of the developing roller 31 between the roller 31 and the walls of the device casing 21 and the fibers 61*a* of the seal member 61 are put in contact with the developing roller 31, toner is blocked by the fibers 61*a* and it hardly enters the gap between the casing 21 and the developing roller 31. Even if the toner enters among the fibers 61*a*, it is caught by the fibers 61*a*. Thus, the toner does not move to the end portion of the developing roller 31, and the toner can surely be prevented from flowing out from the end portion of the roller 31 to the outside of the device casing 21, i.e. into the inside of the body of the facsimile apparatus.

In the state in which the toner is caught by the fibers 61*a*, the charge of the caught toner repels other toner and toner does not easily move forward among the fibers 61*a*.

If the nappy seal member 61 is formed of a material which can be charged with the same polarity of the toner by friction with the developing roller 31, as in the first embodiment, movement of toner among the fibers 61*a* can be more effectively prevented also by the charge of the nappy seal member 61.

Third Embodiment

Figure 8:
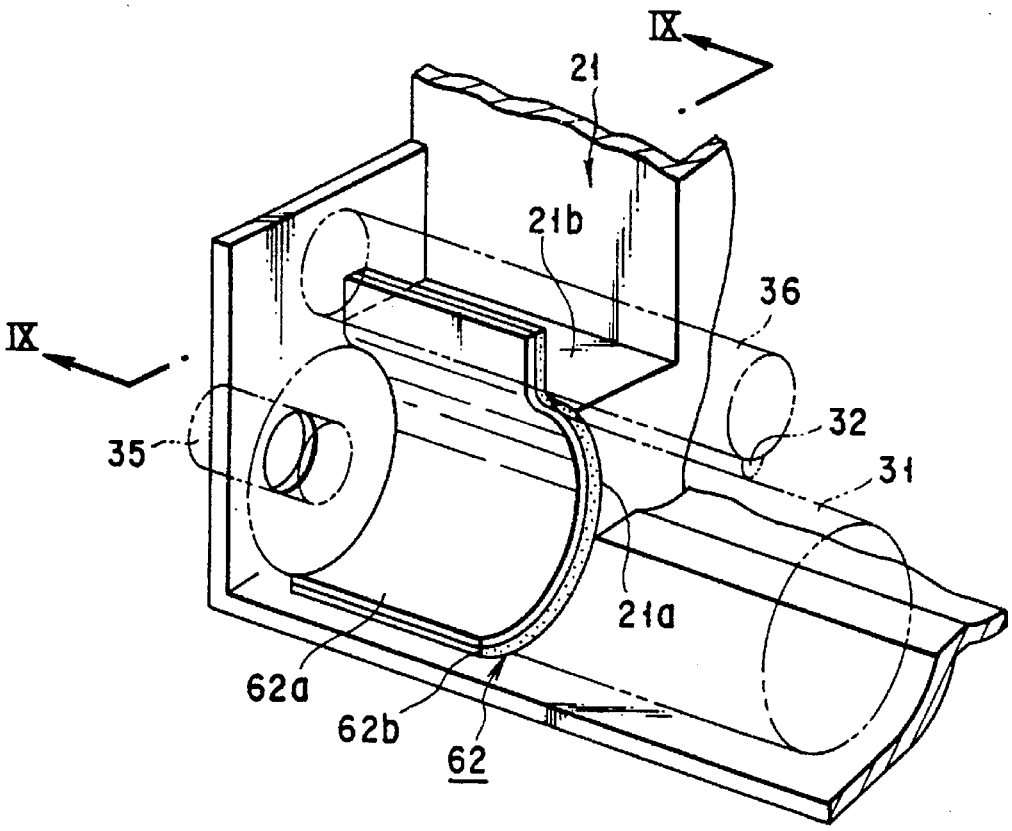
FIG. 8 is a perspective view showing a main structure of a developing device according to a third embodiment of the invention.
Figure 9:
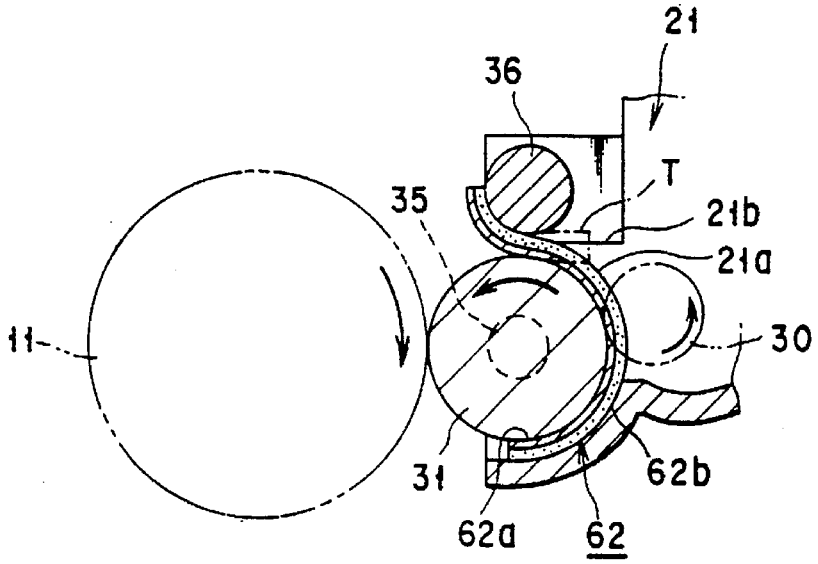
FIG. 9 is a cross-sectional view showing a main structure of the developing device shown in FIG. 8 taken along a line IX—IX shown in FIG. 8.

FIG. 8 is a perspective view showing a main structure of a developing device according to a third embodiment of the invention, and FIG. 9 is a cross-sectional view showing a main structure of the developing device shown in FIG. 8 taken along a line IX—IX shown in FIG. 8. In FIGS. 8 and 9, the elements similar to those shown in FIGS. 2, 4 and 5 are identified with same reference numerals.

As is shown in FIGS. 8 and 9, in the device casing 21, an arcuated portion 21*a* extending along the periphery of the developing roller 31 is formed at a position corresponding to an end portion of the developing roller 31. The arcuated portion 21*a* has a top portion situated near the developing blade 32 and on the toner hopper side of the developing blade 32, and the arcuated portion 21*a* extends to the lower portion of the developing roller 31. A horizontal stepped portion 21*b* is formed to extend from the top portion of the arcuated portion 21*a* towards the toner hopper unit 22.

The length of the developing blade 32 is less than that of the support rod 36, and a gap is formed between the developing roller 31 and the support rod 36 at a position facing the arcuated portion 21*a* and stepped portion 21*b*.

A seal member 62 extends upward along the arcuated portion 21*a*, passes through the gap between the developing roller 31 and support rod 36, projects beyond the developing blade position towards the photosensitive drum 11, and further extends along the periphery of the support rod 36 on the photosensitive drum side.

The seal member 62 has a seal film 62*a* and a sponge sheet 62*b* for lining the seal film 62*a*. The seal member 62 has such a length as to cover half the peripheral length of the developing roller 31 and to extend along the peripheral surface of the support rod 36 on the photosensitive drum side, and a width enough to cover the end portion of the developing roller 31.

The outer surface of the sponge sheet 62*b* is adhered to the arcuated portion 21*a* and the peripheral surface of the support rod 36, for example, by means of a double-sided adhesive tape. Thus, the seal member 62 is fixed on the apparatus casing 21 and support rod 36 non-rotatably. The seal film 62*a* is supported by the sponge sheet 62*b* and is put in close contact with the peripheral surface of the developing roller 31.

The seal film 62*a* is made of a material which can be charged by friction with the developing roller 31 with the same polarity as the polarity of the charged toner. For example, when the toner is made of a polyester material and can be charged negatively, the seal film 62*a* is made of a material which can be charged negatively in sliding contact with the developing roller 31. Specifically, from among chargeable high-molecule resin, a fluororesin such as polytetrafluoroethylene or polyethylene resin, for example, can be used.

FIGS. 8 and 9 show only the structure at one end portion of the developing roller 31, but the structure at the other end portion of the roller 31 is symmetric to that shown in FIGS. 8 and 9.

As has been described above, the seal member 62 is disposed at the end portions of the developing roller 31 between the roller 31 and the casing 21. The seal member 62 extends between the developing roller 31 and support rod 36, projects beyond the developing blade position towards the photosensitive drum 11, and further extends along the peripheral surface of the support rod 36 on the photosensitive drum side. In other words, the seal members 62 extend through the gaps formed between both end portions of the support rod 36 at which the developing blade 32 is not provided, on the one hand, and both end portions of the developing roller 31, on the other hand, towards the photosensitive drum side, i.e. to the downstream side of conveyance of toner with respect to the position where the blade 32 is in contact with the roller 31 (i.e. the downstream side with respect to the rotation of the developing roller 31). Then, the seal member 62 is bent up along the support rod 36.

Since the seal film 62*a* of the seal member 62 is put in close contact with the developing roller 31, the seal film 62*a* is brought into sliding contact with the roller 31 when the roller 31 is rotated. Since the seal film 62*a* is formed of the material which can be charged by friction with the developing roller 31 with the same polarity as the polarity ("negative") of the charged toner, the seal film 62*a* is charged to the negative polarity by the sliding contact with the developing roller 31. On the other hand, since the toner is made of the polyester material which can be charged with the negative polarity, it is charged to the negative polarity by various frictions within the device casing 21. Thus, the toner and seal film 62*a* repel each other, and the toner is prevented from entering the gap between the end portions of the developing roller 31 and the device casing 21.

In addition, since the seal member 62 is attached to the casing 21 and put in close contact with the peripheral surface of the developing roller 31, the gap between the end portion of the roller 31 and the casing 21 is a sum of the surface roughness of the roller 31 and the surface roughness of the seal film 62*a* and is very small. Accordingly, from physical aspects, too, toner hardly enters the gap between the end portion of the developing roller 31 and the casing 21. In particular, if the surfaces of the roller 31 and seal film 62*a* are smoothed so that the sum of the surface roughness of the roller 31 and the surface roughness of the seal film 62*a* may be less than an average particle size of the toner, very few toner particles enter the gap between the end portion of the developing roller 31 and the device casing 21.

Furthermore, part of the seal member 62 is situated on the downstream side of the rotation of the developing roller 31 with respect to the position where the developing roller 31 is in contact with the developing blade 32. Thus it is possible to prevent the toner, which is present on the upstream side with respect to the rotation of the developing roller 31 is in contact with the blade 32, from flowing along the direction perpendicular to the sheet of drawings and along the developing blade 32 and reaching both end portions of the roller 31. In order words, the toner being present at region T in FIG. 9 can be effectively prevented from flowing out.

Since the flow of toner to the end portions of the developing roller 31 can be prevented in this way, it is possible to surely prevent the toner from flowing out of the casing 21 from the end portion of the roller 31 and flowing into the inside of the body of the facsimile apparatus.

When the developing roller 31 is formed of silicone rubber, the seal film 62*a* may be formed of polyamide such as nylon in place of the fluororesin film.

In the second embodiment, the seal member 62 comprises the seal film 62*a* and sponge sheet 62*b*, but only the seal film 62*a* may be used as the seal member.

Fourth Embodiment

Figure 10:
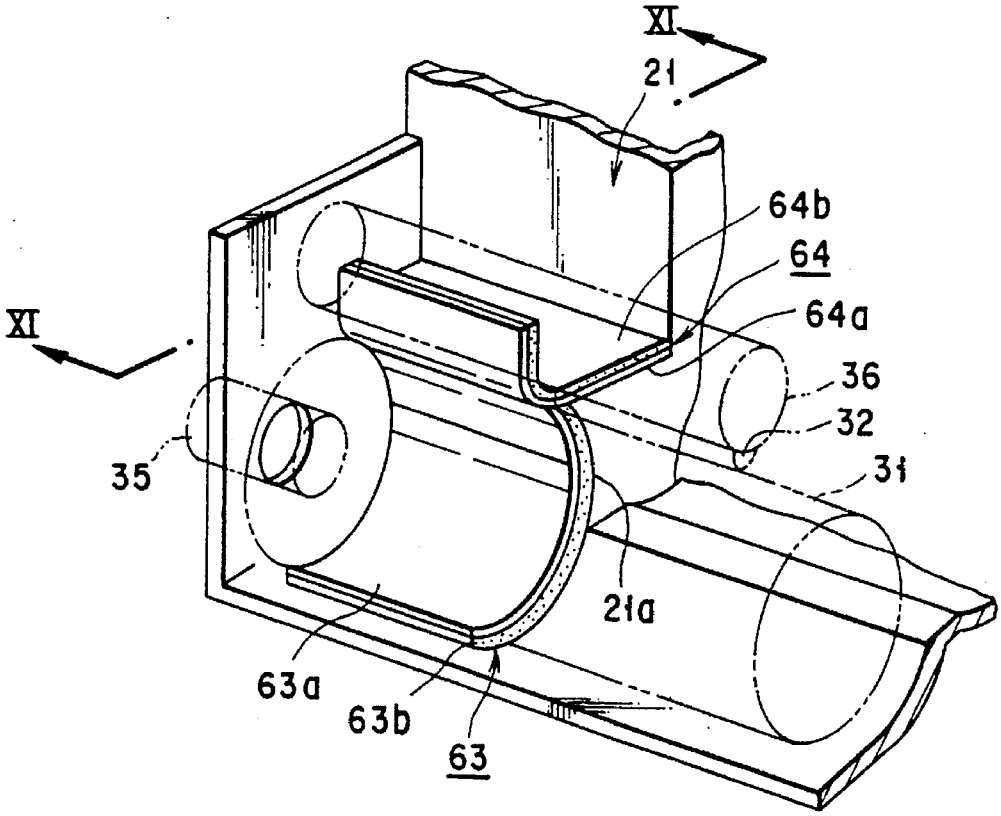
FIG. 10 is a perspective view showing a main structure of a developing device according to a fourth embodiment of the invention.
Figure 11:
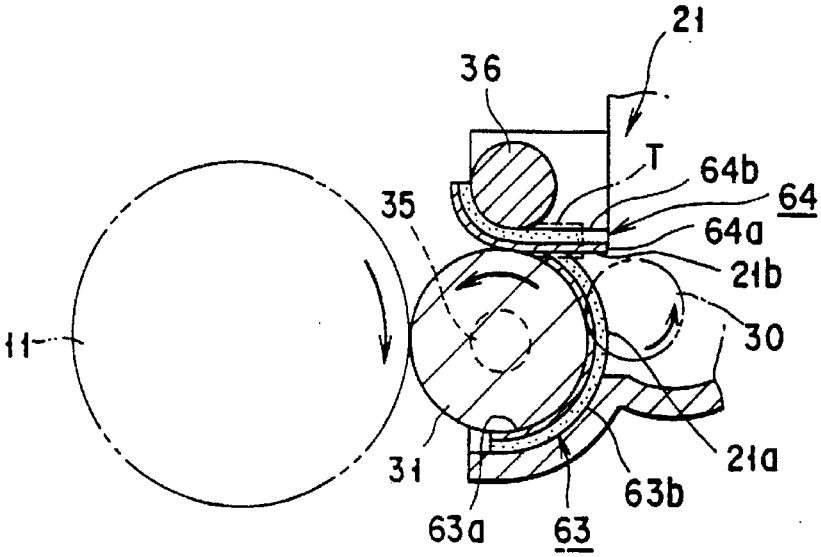
FIG. 11 is a cross-sectional view showing a main structure of the developing device shown in FIG. 10 taken along a line XI—XI shown in FIG. 10.

FIG. 10 is a perspective view showing a main structure of a developing device according to a fourth embodiment of the invention, and FIG. 11 is a cross-sectional view showing a main structure of the developing device shown in FIG. 10 taken along a line XI—XI shown in FIG. 10. In FIGS. 10 and 11, the elements similar to those shown in FIGS. 2, 4 and 5 are identified with same reference numerals.

As is shown in FIGS. 10 and 11, in the device casing 21, an arcuated portion 21*a* extending along the peripheral surface of the developing roller 31 is formed at a position facing the end portion of the developing roller 31. The arcuated portion 21*a* has a top portion situated near the developing blade 32 and on the toner hopper side of the developing blade 32, and the arcuated portion 21*a* extends to the lower portion of the developing roller 31. A horizontal stepped portion 21*b* is formed to extend from the top portion of the arcuated portion 21*a* towards the toner hopper unit 22.

The length of the developing blade 32 is less than that of the support rod 36, and a gap is formed between the developing roller 31 and the support rod 36 at a position facing the arcuated portion 21*a* and stepped portion 21*b*.

A seal member 63 extends along the arcuated portion 21*a*. In addition, another seal member 64 extends along the stepped portion 21*b*, passes through the gap between the developing roller 31 and support rod 36, projects beyond the developing blade 32 towards the photosensitive drum 11, and further extends along the periphery of the support rod 36 on the photosensitive drum side. One end portion of the seal member 63 abuts upon the seal member 64 in the vicinity of the top end portion of the arcuated portion 21*a*.

The seal member 63 has a seal film 63*a* and a sponge sheet 63*b* for lining the seal film 63*a*. The seal member 63 has such a length as to cover half the peripheral length of the developing roller 31 and a width enough to cover the end portion of The developing roller 31.

The outer surface of the sponge sheet 63*b* is adhered to the arcuated portion 21*a*, for example, by means of a double-sided adhesive tape. Thus, the seal member 63 is fixed on the device casing 21 non-rotatably. The seal film 63*a* is supported by the sponge sheet 63*b* and is put in close contact with the peripheral surface of the developing roller 31.

The seal member 64 has a seal film 64*a* and a sponge sheet 64*b* for lining the seal film 64*a*. The seal member 64 has a length enough to extend from a top surface of the stepped portion 21*b* through the gap between the developing roller 31 and the support rod 36 and to project from the position of the developing blade 32 on the photosensitive drum side, and it also has the same width as the seal member 63.

A part of the outer surface of the seal film 64*a* is attached to the stepped portion 21*b* by means of, e.g. a double-sided adhesive tape (not shown). A part of the outer surface of the sponge sheet 64*b* is attached to the peripheral surface of the support rod 36 by means of, e.g. a double-sided adhesive tape (not shown). Thus, the seal member 64 is fixed to the device casing 21 non-rotatably. The seal film 64*a* is supported by the sponge sheet 64*b* between the developing roller 31 and the support rod 36 and is put in close contact with the periphery of the developing roller 31.

The seal films 63*a* and 64*a* are made of a material which can be charged by friction with the developing roller 31 with the same polarity as the polarity of the charged toner. For example, when the toner is made of a polyester material and can be charged negatively, the seal films 63*a* and 64*a* are made of a material which can be charged negatively in sliding contact with the developing roller 31. Specifically, from among chargeable high-molecule resin, a fluororesin such as polytetrafluoroethylene or polyethylene resin, for example, can be used.

FIGS. 10 and 11 show only the structure at one end portion of the developing roller 31, but the structure at the other end portion of the roller 31 is symmetric to that shown in FIGS. 10 and 11.

As has been described above, the seal members 63 and 64 are disposed at the end portions of the developing roller 31 between the roller 31 and the casing 21. The seal member 64 extends between the developing roller 31 and support rod 36, projects beyond the developing blade position towards the photosensitive drum 11, and further extends along the peripheral surface of the support rod 36 on the photosensitive drum side. In other words, the seal member 64 extends through the gaps formed between both end portions of the support rod at which the developing blade 32 is not present, on the one hand, and both end portions of the developing roller 31, on the other hand, towards the photosensitive drum side, i.e. to the downstream side of conveyance of toner with respect to the position where the blade 32 is in contact with the roller 31 (i.e. the downstream side with respect to the rotation of the developing roller 31). Then, the seal member 64 is bent up along the support rod 36.

Since the seal films 63*a* and 64*a* of the seal members 63 and 64 are put in close contact with the developing roller 31, the seal films 63*a* and 64*a* are brought into sliding contact with the roller 31 when the roller 31 is rotated. Since the seal films 63*a* and 64*a* are formed of the material which can be charged by friction with the developing roller 31 with the same polarity as the polarity ("negative") of the charged toner, the seal films 63*a* and 64*a* are charged to the negative polarity by the sliding contact with the developing roller 31. On the other hand, since the toner is made of the polyester material which can be charged with the negative polarity, it is charged to the negative polarity by various frictions within the device casing 21. Thus, the toner and seal films 63*a* and 64*a* repel each other, and the toner is prevented from entering the gap between the end portions of the developing roller 31 and the device casing 21.

In addition, since the seal members 63 and 64 are attached to the casing 21 and put in close contact with the peripheral surface of the developing roller 31, the gap between the end portion of the roller 31 and the casing 21 is a sum of the surface roughness of the roller 31 and the surface roughness of the seal film, 63*a*, or a sum of the surface roughness of the roller 31 and the surface roughness of the seal film 64*a*, and this gap is very small. Accordingly, from physical aspects, too, toner hardly enters the gap between the end portion of the developing roller 31 and the casing 21. In particular, if the surfaces of the roller 31 and seal films 63*a* and 64*a* are smoothed so that the sum of the surface roughness of the roller 31 and the surface roughness of the seal film 63*a*, or a sum of the surface roughness of the roller 31 and the surface roughness of the seal film 64*a*, may be less than an average particle size of the toner, very few toner particles enter the gap between the end portion of the developing roller 31 and the device casing 21.

Furthermore, part of the seal member 64 is situated on the downstream side with respect to the rotation of the developing roller 31. Thus, it is possible to prevent the toner, which is present on the upstream side with respect to the rotation of the developing roller 31, from flowing along the direction perpendicular to the sheet of the drawing and along the developing blade 32 and reaching the end portions of the roller 31. In order words, the toner being present at region T in FIG. 11 can be effectively prevented from flowing out.

Since the flow of toner to the end portions of the developing roller 31 can be prevented in this way, it is possible to surely prevent the toner from flowing out of the casing 21 from the end portion of the roller 31 and flowing into the inside of the body of the facsimile apparatus.

In the fourth embodiment, since the two seal members 63 and 64 are arranged, it is easier to attach them, as compared to the case of the third embodiment wherein the single seal member 62 must be curved in a complex shape. Thus, the productivity is increased.

When the developing roller 31 is formed of silicone rubber, the seal films 63*a* and 64*b* may be formed of a polyamide such as nylon in place of the fluororesin film.

In the fourth embodiment, the seal members 63 and 64 comprise, respectively, the seal films 63*a* and 64*a* and sponge sheets 63*a* and 64*b*, but only the seal films 63*a* and 64*a* may be used as the seal members.

Fifth Embodiment

Figure 12:
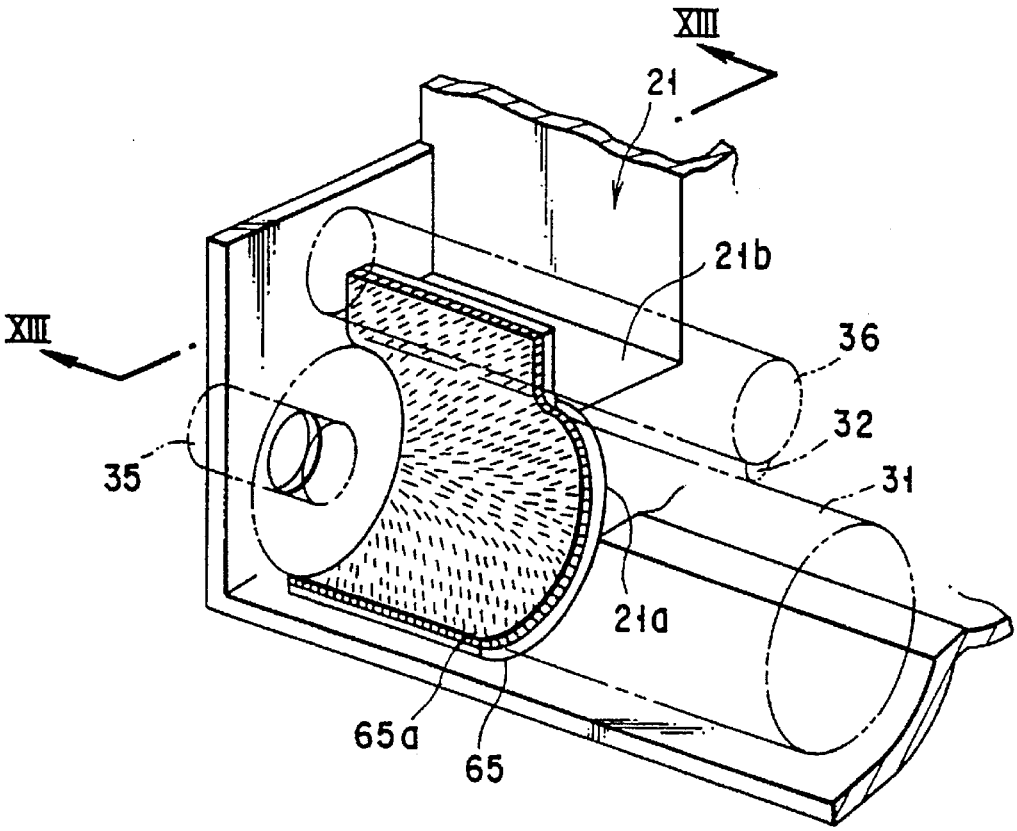
FIG. 12 is a perspective view showing a main structure of a developing device according to a fifth embodiment of the invention.
Figure 13:
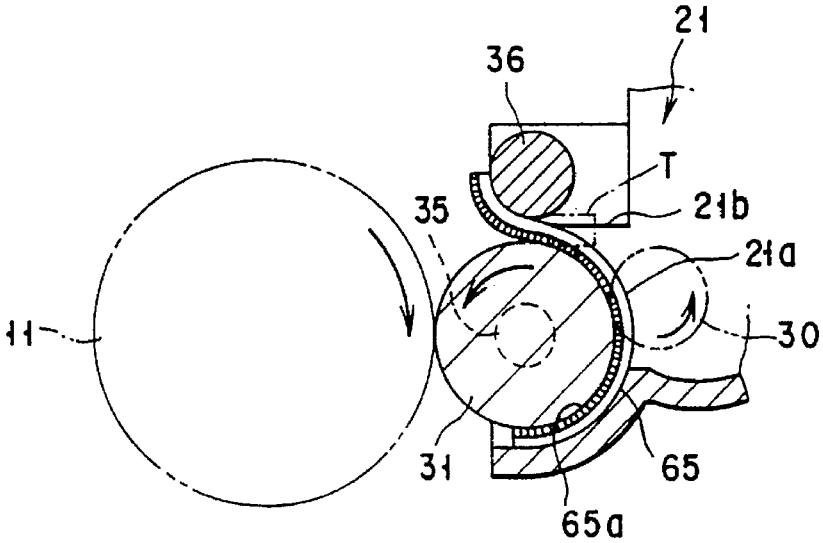
FIG. 13 is a cross-sectional view showing a main structure of the developing device shown in FIG. 12 taken along a line XIII—XIII shown in FIG. 12.

FIG. 12 is a perspective view showing a main structure of a developing device 13 according to a fifth embodiment of the invention. FIG. 13 is a cross-sectional view showing a main structure of the developing device shown in FIG. 12 taken along a line XIII—XIII shown in FIG. 10. In FIGS. 12 and 13, the elements similar to those shown in FIGS. 2, 4 and 5 are identified with same reference numerals.

The structure of the fifth embodiment is substantially identical to that of the third embodiment, except that the seal member 62 is replaced by a nappy (fiber) seal member 65.

The nappy seal member 65 has one surface napped so that a great number of short fibers 65*a* are erected. The seal member 65 is formed of fluorine-based fibers or acryl fibers. The other surface of the seal member 65, on which no fibers 65*a* are formed, is adhered to the arcuated portion 21*a* and the periphery of the support rod 36 by, e.g. a double-sided adhesive tape (not shown). Thus, the nappy seal member 65 is fixed on the device casing 21 in a non-rotatable state. The fibers 65*a* are put in contact with the peripheral surface of the developing roller 31.

FIGS. 12 and 13 show only the structure at one end portion of the developing roller 31, but the structure at the other end portion of the roller 31 is symmetric to that shown in FIGS. 12 and 13.

As has been described above, the nappy seal member 65 is disposed at the end portions of the developing roller 31 between the roller 31 and the casing 21. The nappy seal member 65 extends between the developing roller 31 and support rod 36, projects beyond the developing blade 32 towards the photosensitive drum 11, and further extends along-the peripheral surface of the support rod 36 on the photosensitive drum side. In other words, the nappy seal member 65 extends through the gaps formed between both end portions of the support rod 36 at which the developing blade 32 is not provided, on the one hand, and both end portions of the developing roller 31, on the other hand, towards the photosensitive drum side, i.e. to the downstream side of conveyance of toner with respect to the position where the blade 32 is in contact with the roller 31 (i.e. the downstream side with respect to the rotation of the developing roller 31). Then, the seal member 65 is bent up along the support rod 36.

Since the fibers 65*a* of the seal member 65 are put in contact with the surface of the developing roller 31 at the ends of the developing roller 31, toner is blocked by the fibers 65*a* and it hardly enters the gap between the casing 21 and the developing roller 31. Even if the toner sifts among the fibers 65*a*, it is caught by the fibers 65*a*. Thus, the toner does not move to the end portion of the developing roller 31, and the toner can surely be prevented from flowing out from the end portion of the roller 31 to the outside of the device casing 21, i.e. into the inside of the body of the facsimile apparatus.

Furthermore, part of the seal member 65 is situated on the downstream side of the rotation of the developing roller 31 with respect to the position where the developing roller 31 is in contact with the developing blade 32. Thus, it is possible to prevent the toner, which is present on the upstream side with respect to the rotation of the developing roller 31 with respect to the position where the roller 31 is in contact with the blade 32, from flowing along the direction perpendicular to the sheet of the drawing and along the developing blade 32 and reaching both end portions of the roller 31. In order words, the toner being present at region T in FIG. 13 can be effectively prevented from flowing out.

In the state in which the toner is caught by the fibers 65*a*, the charge of the caught toner repels other toner and toner does not easily move forward among the fibers 65*a*.

If the nappy seal member 65 is formed of a material which can be charged with the same polarity of the toner by friction with the developing roller 31, as in the first embodiment, movement of toner among the fibers can be more effectively prevented also by the charge of the nappy seal member 65.

Sixth Embodiment

Figure 14:
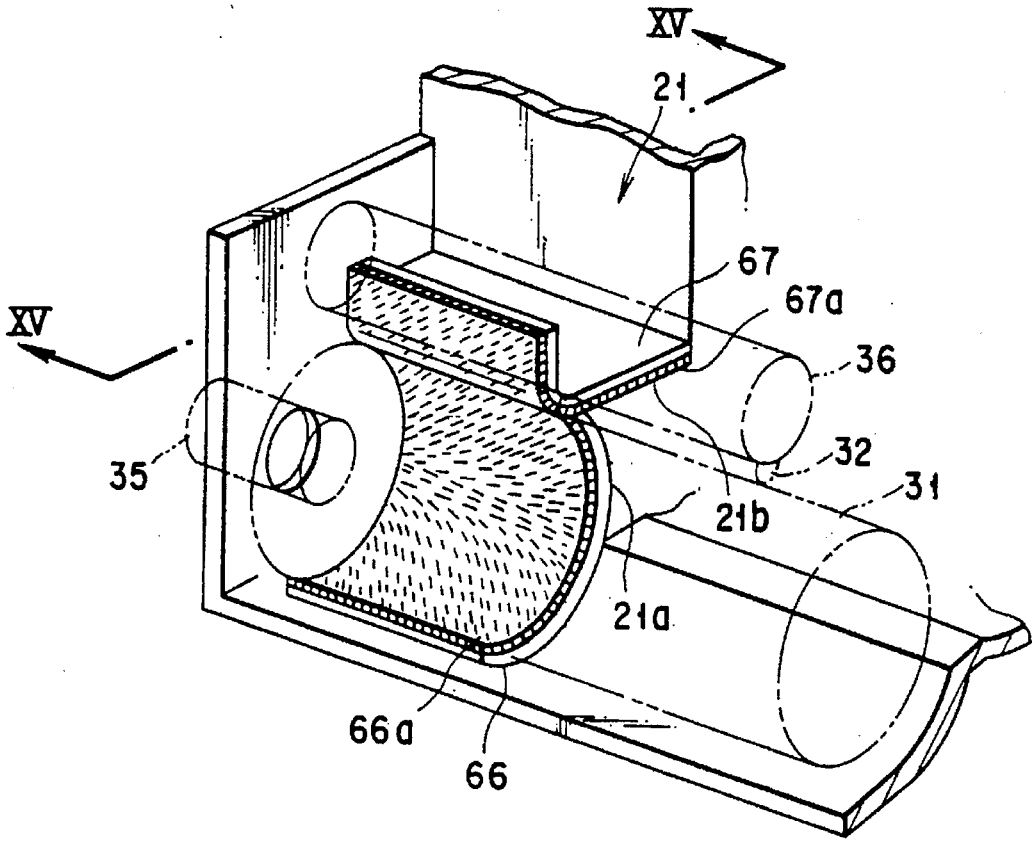
FIG. 14 is a perspective view showing a main structure of a developing device according to a sixth embodiment of the invention.
Figure 15:
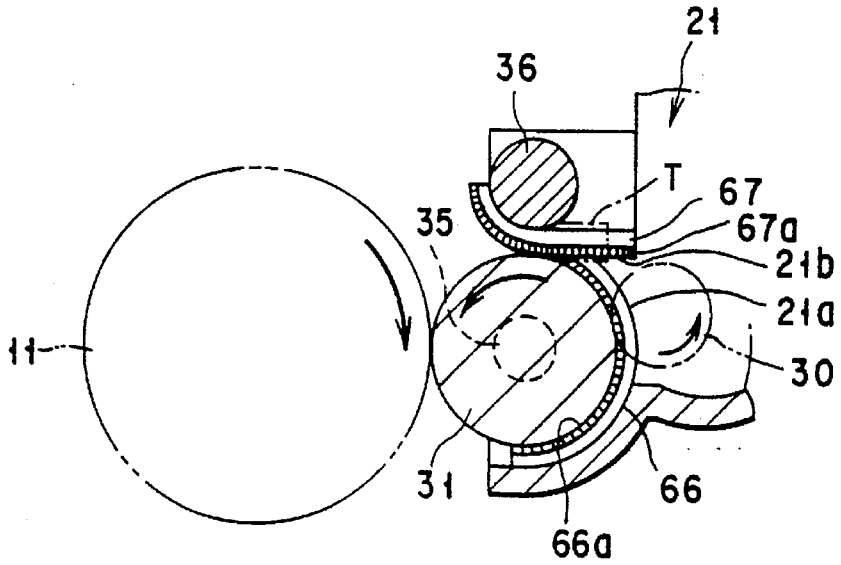
FIG. 15 is a cross-sectional view showing a main structure of the developing device shown in FIG. 14 taken along a line XV—XV shown in FIG. 14.

FIG. 14 is a perspective view showing a main structure of a developing device 13 according to a sixth embodiment of the invention, and FIG. 15 is a cross-sectional view showing a main structure of the developing device shown in FIG. 14 taken along a line XV—XV shown in FIG. 14. In FIGS. 14 and 15, the elements similar to those shown in FIGS. 2, 4 and 5 are identified with same reference numerals.

The structure of the sixth embodiment is substantially identical to that of the embodiment, except that the seal member 63 in the fourth embodiment is replaced by a nappy seal member 66 and the seal member 64 is replaced by a nappy seal member 67.

Each of the nappy seal members 66 and 67 has one surface napped so that a great number of short fibers 66*a* and 67*a* are erected. The seal members 66 and 67 are formed of fluorine-based fibers or acryl fibers.

The nappy seal members 66 and 67 are disposed at the end portions of the developing roller 31 between the roller 31 and the casing 21. The nappy seal member 67 extends between the developing roller 31 and support rod 36, projects beyond the developing blade position towards the photosensitive drum 11, and further extends along the peripheral surface of the support rod 36 on the photosensitive drum side. In other words, the nappy seal members 67 extend through the gaps formed between both end portions of the support rod 36 at which the developing blade 32 is not provided, on the one hand, and both end portions of the developing roller on the other hand, towards the photosensitive drum side, i.e. to the downstream side of conveyance of toner with respect to the position where the blade 32 is in contact with the roller 31 (i.e. the downstream side with respect to the rotation of the developing roller 31). Then, the nappy seal member 67 is bent up along the support rod 36.

Since the fibers 66*a* and 67*a* of the nappy seal members 66 and 67 are put in contact with the surface of the developing roller 31 at the ends of the developing roller 31, toner is blocked by the fibers 66*a* and 67*a* and it hardly enters the gap between the casing 21 and the developing roller 31. Even if the toner sifts among the fibers 66*a* or fibers 67*a*, it is caught by the fibers 66*a* and 67*a*. Thus, the toner does not move to the end portion of the developing roller 31, and the toner can surely be prevented from flowing out from the end portion of the roller 31 to the outside of the device casing 21, i.e. into the inside of the body of the facsimile apparatus.

Furthermore, part of the nappy seal member 67 is situated on the downstream side of the developing roller 31 with respect to the position where the roller 31 is in contact with the blade 32. Thus, it is possible to prevent the toner, which is present on the upstream side of the developing roller 31 with respect to the position where the roller 31 is in contact with the blade 32, from flowing along the direction perpendicular to the sheet of the drawing and along the developing blade 32 and reaching both end portions of the roller 31. In order words, the toner being present at region T in FIG. 15 can be effectively prevented from flowing out.

In the state in which the toner is caught by the fibers 66*a* and 67*a*, the charge of the caught toner repels other toner and toner does not easily move forward among the fibers 66*a* or 67*a*.

In the sixth embodiment, since the two nappy seal members 66 and 67 are arranged, it is easier to attach them, as compared to the case of the fifth embodiment wherein the single nappy seal member 65 must be curved in a complex shape. Thus, the productivity is increased.

If the nappy seal member 66 and 67 are formed of a material which can be charged with the same polarity as the toner by friction with the developing roller 31, as in the first embodiment, movement of toner among the fibers can be more effectively prevented also by the charge of the nappy seal members 66 and 67.

In the third to sixth embodiments, the length of the developing blade 32 is less than that of the support rod 36, the gap is formed between both end portions of the developing roller 31, on the one hand, and both end portions of the support rod 36, on the other hand, and the seal member 62, seal member 64, nappy seal member 65 or nappy seal member 67 is situated in this gap. In this case, if the developing blade 32 is displaced in its longitudinal direction, a gap is formed between the developing blade 32 and the seal member 62, seal member 64, nappy seal member 65, or nappy seal member 66.

To solve this problem, the developing blade 32 needs to be firmly held. Thus, the developing blade 32 is held by structures described below.

Figure 16:
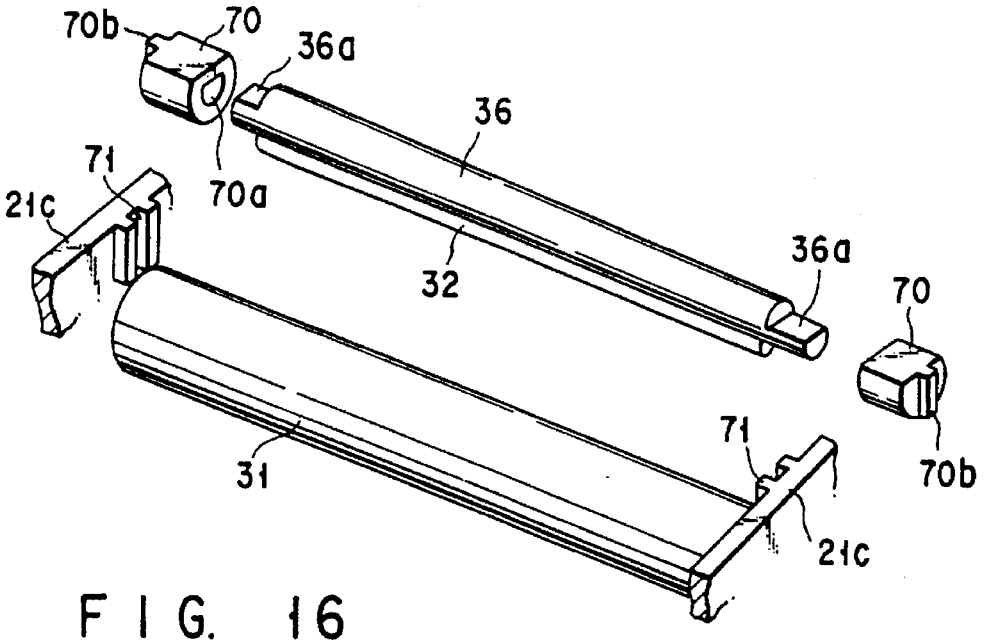
FIG. 16 is a perspective view showing a structure for holding a developing blade.

FIG. 16 is a perspective view showing a structure for holding the developing blade 32.

D-shaped portions 36*a* each having a D-shaped cross section and extending in the longitudinal direction of the support rod 36 are formed at both end portions of the support rod 36. Holders 70 are attached to the D-shaped portions 36*a*.

A D-shaped hole 70*a* engageable with the D-shaped portion 36*a* of the support rod 36 is formed in each holder 70. A projection 70*b* is formed on that end face of each holder 70, which is opposite to the end face with the D-shaped hole 70*a*. The D-shaped portions 36*a* of the support rod 36 are engaged in the D-shaped holes 70*a*, and thus the holders 70 are attached to the support rod 36. The projections 70*b* of the holders 70 are situated vertically.

A pair of vertical linear grooves 71 are formed in the inner surfaces of the side walls 21*c* of the device casing 21, such that the grooves 71 are located above the developing roller 31 and face each other. Upper and lower ends of each groove 71 are opened, and the projection 70*b* of each of the holders 70 engaged with both end portions of the support rod 36 is removably inserted in the associated groove 71 from the above. Thus, both end portions of the support rod 36 are supported on the device casing 21 by means of the holders 70, such that both end portions of the rod 36 are linearly and horizontally movable so as to approach and move away from the developing roller 31. The grooves 71 of the device casing 21 are precisely formed integral with the device casing 21 when the casing 21 is formed of a synthetic resin.

A downward force is applied to the support rod 36 by the spring member 37 (see FIG. 2) in the state in which the support rod 36 is supported by the casing 21. Thereby, the support rod 36 is urged towards the developing roller 31, and a tip portion of the developing blade 32 is pressed on the peripheral surface of the developing roller 31.

According to this structure, both end portions of the support rod 36 are supported so as to be linearly movable only in such a direction as to approach and move away from the developing roller 31. Therefore, the position of the support rod 36 in its longitudinal direction is exactly restricted, and longitudinal displacement of the developing blade 32 can be prevented.

Since the longitudinal position of the support rod 36 is precisely restricted, longitudinal displacement of the support rod 36 does not easily occur and high parallelism between the developing roller 31 and developing blade 32 can be easily maintained. As a result, stable contact between the roller 31 and blade 32 can be maintained, and the blade 32 can be operated in good condition to charge the toner by friction with the developing roller 31. This structure is effectively applicable to developing devices other than the third to sixth embodiments.

The assembly is very easy since the projections 70*b* of the holders 70 are simply inserted in the grooves 71 of the device casing 21.

Furthermore, the D-shaped portions 36*a* of the support rod 36 are engaged in the D-shaped holes 70*a* of the holders 70, and thereby rotation of the round support rod 36 can be prevented with simple structure.

In order to maintain positional precision of the developing roller 31 and developing blade 32, the member for movably supporting the support rod 36 must be the same as the member for supporting the developing roller 31. In the present embodiment, since the developing roller 31 is supported by the device casing 21, the support rod 36, too, is supported by the casing 21.

The structure for preventing rotation of the support rod 36 is not limited to the above, and various modifications can be made, as will be described below.

Figure 17:
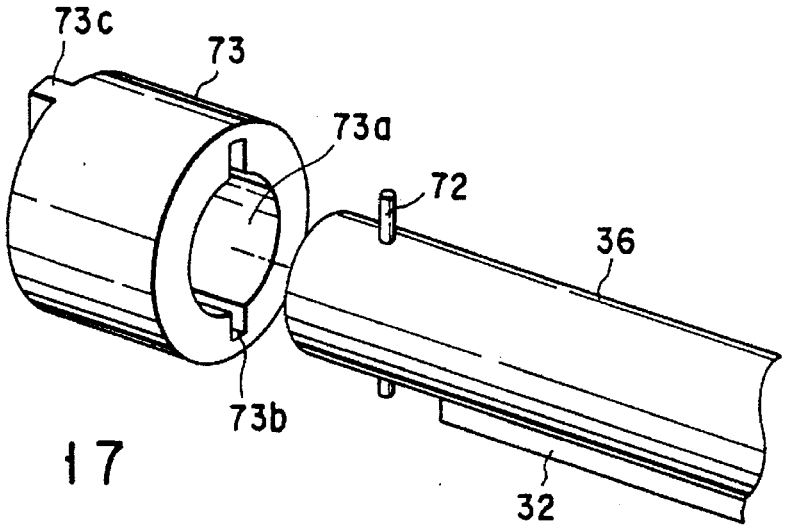
FIG. 17 is a perspective view showing a first modification of the structure for holding the developing blade.

FIG. 17 is a perspective view showing a first modification of the structure for preventing rotation of the support rod 36.

In this first modification, a diametrically projecting pin 72 is provided at a peripheral portion of each of both end portions of the support rod 36. A circular hole 73*a* engageable with an end portion of the rod 36 and a slit 73*b* engageable with the pin 72 are formed in one end face of a holder 73. When the end portion of the support rod 36 is fitted in the circular hole 73*a* of the holder 73, the pin 72 is engaged in the slit 73*b* so that rotation of the support rod 36 is prevented. A projection 73*c* engageable in the groove 71 of the device casing 21 is formed on the other end face of the holder 73.

Figure 18:
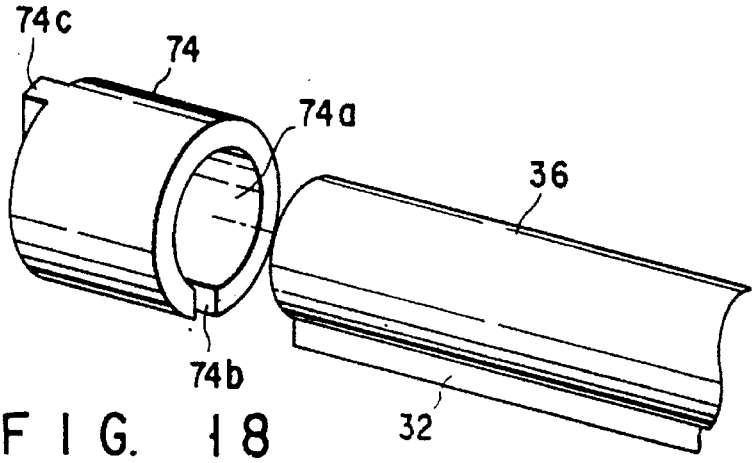
FIG. 18 is a perspective view showing a second modification of the structure for holding the developing blade.

FIG. 18 is a perspective view showing a second modification of the structure for preventing rotation of the support rod.

In this modification, a circular hole 74*a* engageable with an end portion of the rod 36 and a slit 74*b* engageable with an end portion of the developing blade 32 are formed in one end face of a holder 74. When the end portion of the support rod 36 is fitted in the circular hole 74*a* of the holder 74, the end portion of the developing blade 32 is engaged in the slit 74*b* of the holder 74 so that rotation of the support rod 36 is prevented by the holder 74. A projection 74*c* engageable in the groove 71 of the device casing 21 is formed on the other end face of the holder 74.

According to this structure, the support rod 36 need not be subjected to special machining, and the manufacturing cost is low. In addition, the developing blade 32 and the support rod 36 can be formed integrally of a synthetic resin having high sliding properties.

Figure 19:
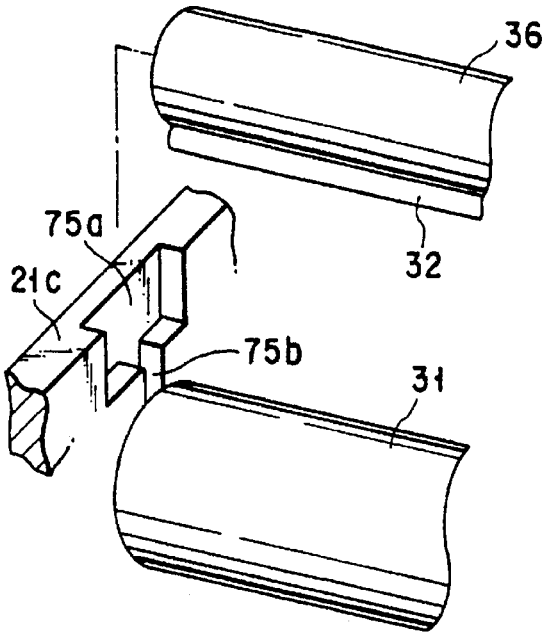
FIG. 19 is a perspective view showing a third modification of the structure for holding the developing blade.

FIG. 19 is a perspective view showing a third modification of the structure for preventing rotation of the developing blade.

In this modification, a recess 75*a* having a width equal to the diameter of the support rod 36 and a groove 75*b* having a width equal to the thickness of the developing blade 32 are formed in an inner surface of the side wall 21*c* of the device casing 21. An end portion of the support rod 36 is engaged in the recess 75*a* and accordingly the developing blade 32 is engaged in the groove 75*b*. Thus, rotation of the support rod 36 is prevented.

Figure 20:
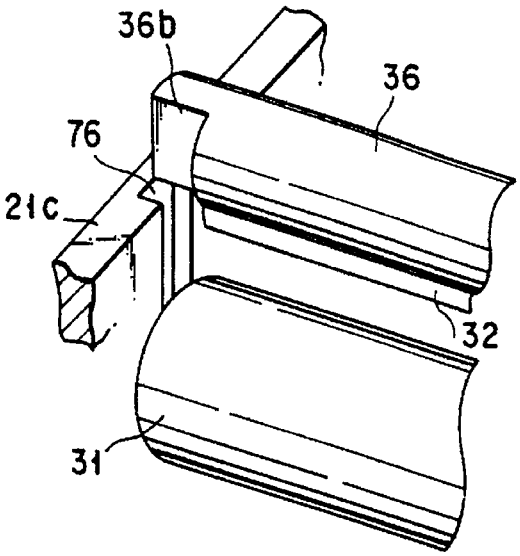
FIG. 20 is a perspective view showing a fourth modification of the structure for holding the developing blade.

FIG. 20 is a perspective view showing a fourth modification of the structure for preventing rotation of the support rod 36.

A flat portion 36*b* is projected from an end portion of the support rod 36. A groove 76 is formed in an inner surface of the side wall 21*c* of the device casing 21. The flat portion 36*b* of the support rod 36 engaged in the groove 76, and thus rotation of the rod 36 is prevented.

Figure 21:
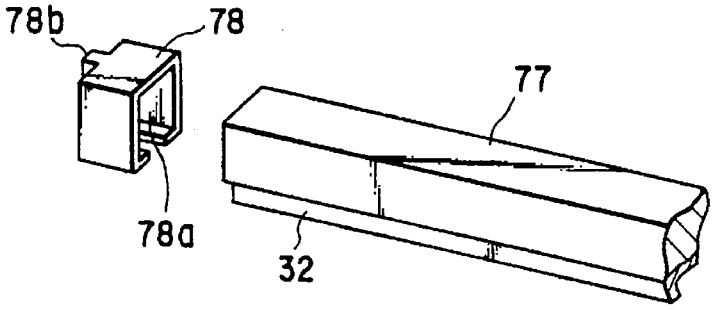
FIG. 21 is a perspective view showing a modification of the structure of a holding rod.
Figure 22:
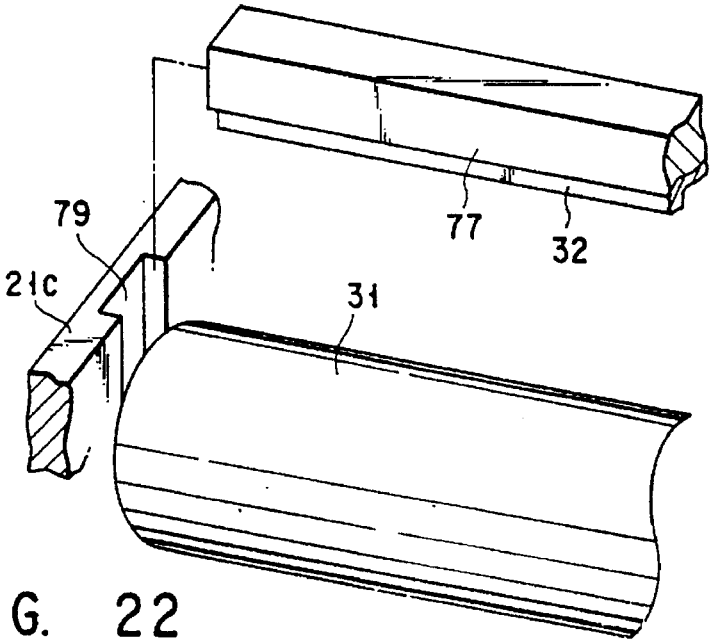
FIG. 22 is a perspective view showing another modification of the structure of the holding rod.

As is shown in FIGS. 21 and 22, a support rod 77 formed of a rectangular rod may be substituted for the round support rod described above. In this case, for example, as shown in FIG. 21, an end portion of the support rod 77 is fitted in a holder 78 having in one end surface thereof a rectangular hole 78*a* engageable with the end portion of the rod 77. A projection 78*b* formed on the other end face of the holder 78 is engaged in the groove 71 of the device casing 21. Alternatively, as shown in FIG. 22, a groove 79 engageable with the rectangular support rod 77 is formed in the inner surface of the side wall 21*c* of the casing 21, and the support rod 77 is directly engaged in the groove 79.

By supporting the supporting rod 36 with the above structure, it is possible to reduce the gap between the developing blade 32 and the seal member 62, seal member 64, nappy seal member 65, or nappy seal member 67. However, in fact, there may be a slight gap therebetween.

Figure 23:
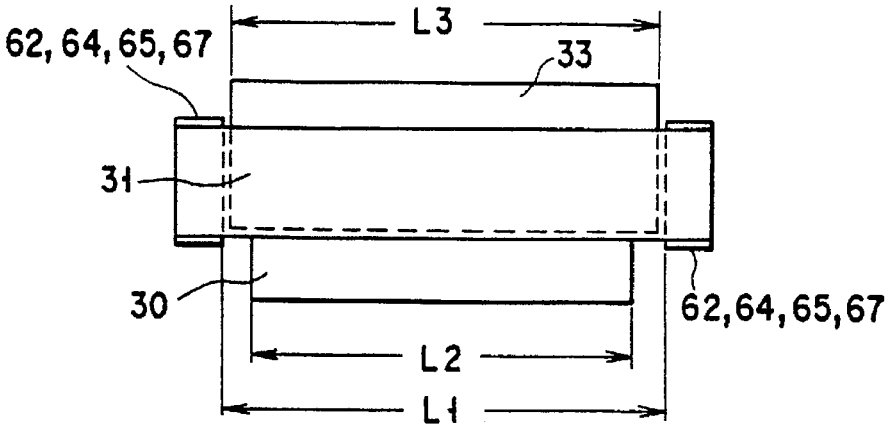
FIG. 23 shows schematically the positional relationship between a developing roller, a supply roller, and a receiving blade.

To solve this problem, as shown in FIG. 23, the length L2 of the supply roller 30 is made less than the distance L1 between the seal members (seal members 62 or 64; nappy seal members 65 or 67) arranged on both sides of the developing roller 31, such that the supply roller 30 does not overlap the area of the seal members.

Thereby, toner supply is not actively performed between the seal members and the developing blade, and the amount of toner conveyed to the photosensitive drum 11 through the gap between the seal members and the developing blade is reduced.

In addition, as shown in FIG. 23, the length L3 of the receiving blade 33 is set to substantially correspond to the distance L1 between the seal members, and the receiving blade 33 is situated between the seal members.

Thus, it is possible to surely recover the toner which has been conveyed to the photosensitive drum 11 through the gap between the seal members and the developing blade and returned into the device casing 21.

Next, a structure for preventing toner from leaking out of the waste toner tank 40 in the cleaning device 14.

Figure 24A:
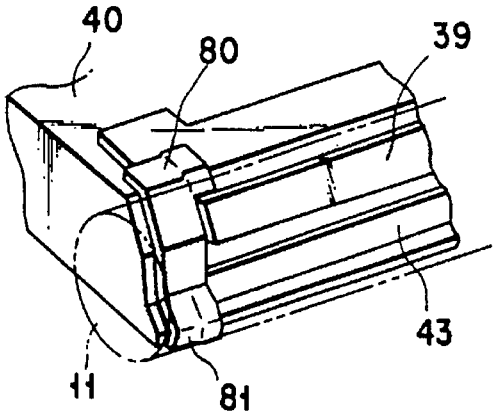
FIGS. 24A and 24B are perspective views showing main structures of a cleaning device.
Figure 24B:
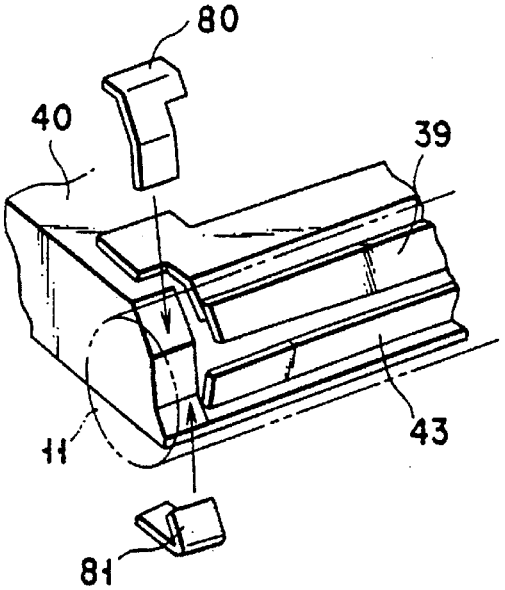

FIGS. 24A and 24B are a perspective view showing a main structure of the cleaning device 14. FIGS. 24A and 24B show only the structure at one end of the cleaning device 14, but the structure at the other end is symmetric to that shown in FIGS. 24A and 24B.

As is shown in FIGS. 24A and 24B, an upper drum seal member 80 and a lower drum seal member 81 are provided on that outer surface of the end portion of the waste toner tank 40, which faces the photosensitive drum 11.

The upper and lower drum seal members 80 and 81 are made of a seal material such as felt and are attached to the waste toner tank 40 by means of, e.g. a double-sided adhesive tape.

The upper drum seal member 80 is attached to an upper portion of the waste toner tank 40 and to an end portion of the cleaning blade 39. The upper drum seal member 80 is put in contact with the outer periphery of the photosensitive drum 11. Thus, the upper drum seal member 80 closes the gap between the drum 11 and the tank 40 and prevents toner from leaking out. At the same time, the upper drum seal member 80 covers the gap between the end face of the cleaning blade 39 and the waste toner tank 40 and prevents the toner removed by the cleaning blade 39 from the photosensitive drum 11 from leaking out.

The lower drum seal member 81 is situated to be continuous with the upper drum seal member 80, and the lower drum seal member 81 is attached to a lower portion of the waste toner tank 40 and to an end portion of the receiving blade 43. The lower drum seal member 81 is put in contact with the outer periphery of the photosensitive drum 11. Thus, the lower drum seal member 81 closes the gap between the drum 11 and the tank 40 and prevents toner from leaking out. At the same time, the lower drum seal member 81 covers the gap between the end face of the receiving blade 43 and the waste toner tank 40 and prevents the toner removed by the cleaning blade 39 from the photosensitive drum 11 from leaking out.

Figure 25:
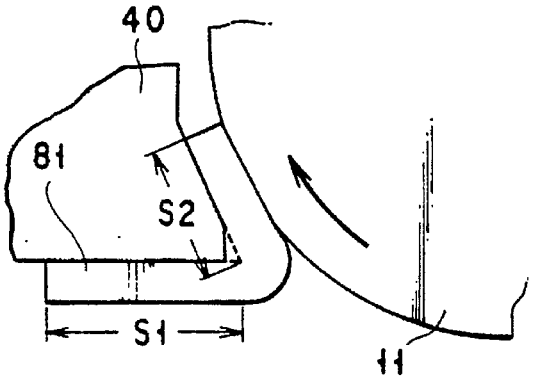
FIG. 25 shows the state in which a lower-side drum seal shown in FIGS. 24A and 24B is attached.

As is shown in FIG. 25, the lower drum seal member 81 extends from the front surface (facing the photosensitive drum 11) of the waste toner tank 40 to the bottom surface, and the lower drum seal member 81 is attached to both the front and bottom surfaces of the tank The length S2 of adhesion on the front surface of the tank 40 (i.e. the length of adhesion of the portion put in contact with the drum 11) is less than the length S1 of adhesion on the bottom surface of the tank 40 (i.e. the length of adhesion of the portion not in contact with the drum 11). Thereby, the portion of the seal member 81, which does not directly receive the torque of the drum 11, is attached to the tank 40 with a greater strength, and the lower drum seal member 81 is prevented from being separated or displaced owing to the sliding contact with the photosensitive drum 11.

The material, shape, size and thickness of each of the upper and lower drum seal members 80 and 81 are determined independently.

Specifically, the size of the gap between the end face of the cleaning blade 39 and the waste toner tank 40 differs from that of the gap between the end face of the receiving blade 43 and the tank 40. Thus, the optimal shapes and sizes of the upper and lower drum seal members 80 and 81 for covering the respective gaps are determined. Accordingly, the respective gaps can be surely by covered with simple structure.

The distance between the photosensitive drum 11 and the upper part of waste toner tank 40 differs from the distance between the drum 11 and the lower part of the tank 40. The thickness and material (e.g. length of felt fiber, etc.) of each of the upper and lower drum seal members 80 and 81 are set in accordance with the distance between the drum 11 and tank 40 at the position where the seal member 80 or 81 is situated.

The material, shape, size and thickness of each of the upper and lower drum seal members 80 and 81 are determined in accordance with the above conditions as well as the conditions: a total load applied by the drum seal members to the photosensitive drum 11 is 2.5 Kg.cm or more. The lower drum seal member 81 can be designed to suitably adjust a load applied to the drum 11. Specifically, by adjusting the thickness of the lower drum seal member 81, the load to the drum 11 can be controlled.

A sufficient load can be applied to the photosensitive drum 11 by adjusting the load to the drum 11 in the above manner. A too small load to the drum 11 may result in non-uniform rotation of the gears which drive the drum 11 or non-uniform rotation of the drum 11 due to friction with the contact member such as cleaning blade 39. If such non-uniform rotation occurs, the image quality may deteriorate. However, according to this embodiment, a sufficient and constant load can be applied to the photosensitive drum 11, as stated above, and the rotation of the drum 11 can be stabilized.

A load is applied to the photosensitive drum 11 by contact between the drum 11 and the developing roller 31, transfer roller 45, and cleaning blade 39. In this case, the contact pressure is limited under various conditions relating to development, transfer, and cleaning. According to the present embodiment, the lower drum seal member 81 is utilized to apply a sufficient load to the photosensitive drum 11.

Additional advantages and modifications will readily occur to those skilled in the art. Therefore, the present invention in its broader aspects is not limited to the specific details, representative devices, and illustrated examples shown and described herein. Accordingly, various modifications may be made without departing from the spirit or scope of the general inventive concept as defined by the appended claims and their equivalents. For example, the electrophotographic device is not limited to the facsimile device but the present invention may be applied to a copying machine, a laser beam printer, an LED printer, or the like.

What is claimed is:

1. An electrophotographic apparatus for developing an electrostatic latent image with toner, comprising:

a photosensitive member having a surface on which the electrostatic latent image is formed;

a developing roller for carrying and conveying toner and placing the toner in contact with the surface of the photosensitive member;

a toner restriction member, in contact with the developing roller, for restricting an amount of toner carried and conveyed by the developing roller and charging the toner by friction;

a casing for containing toner supplied to the developing roller, the casing including an inner wall facing side end portions of a surface of the developing roller, the inner wall being located at an upstream side of conveyance of toner with respect to the toner restriction member;

at least one seal between the side end portions of the surface of the developing roller and the inner wall of the casing;

a spent toner container for containing toner removed from the surface of the photosensitive member;

a toner removing member fixed to the toner container for removing toner from the surface of the photosensitive member;

a toner receiving member, fixed to the toner container, for receiving the toner removed from the surface of the photosensitive member and guiding the toner to the toner container;

a first seal member, attached to the toner container, for sealing a gap between the toner container and the toner removing member; and a second seal member, attached to the toner container, for sealing a gap between the toner container and the toner receiving member.

2. The apparatus of claim 1, further comprising a supply roller for conveying the toner contained in the casing and supplying the toner to the developing roller, wherein the developing roller includes a predetermined toner carrying area and the supply roller has a width less than width of the toner carrying area of the developing roller.

3. The apparatus of claim 1, further comprising a toner receiving blade for preventing toner from escaping to the outside of the casing, wherein the developing roller has a predetermined toner carrying area and the toner receiving blade has a length substantially equal to the width of the toner carrying area.

4. A cleaning device for removing toner attached to a surface of a photosensitive member, the cleaning device comprising:

a toner container for containing toner removed from the surface of the photosensitive member;

a toner removing member fixed to the toner container and adapted to be put in contact with the surface of the photosensitive member;

a toner receiving member, fixed to the toner container, for receiving the toner removed from the surface of the photosensitive member and guiding the toner to the toner container;

a first seal member, attached to the toner container, for sealing a gap between the toner container and the toner removing member; and a second seal member, attached to the toner container, for sealing a gap between the toner container and the toner receiving member.

5. A cleaning device according to claim 4, in which said second seal member has a first portion, which is in contact with the surface of the photosensitive member, and a second portion, which is attached to said toner container, and the length of an attachment area between the second portion and the toner container is greater than that of a contact area between the first portion and the toner container.

* * * * *